US005239919A

United States Patent [19]

Maki et al.

[11] Patent Number: 5,239,919

[45] Date of Patent: Aug. 31, 1993

[54] CONTROLLER FOR MATERIAL BALER

[75] Inventors: Wayne Maki; Forrest Wildes, both of Baxley; Chris A. Jefferson, Hazlehurst, all of Ga.

[73] Assignee: Harris Waste Management Group, Inc., Peachtree City, Ga.

[21] Appl. No.: 683,606

[22] Filed: Apr. 10, 1991

[51] Int. Cl.[5] ..... B30B 13/00

[52] U.S. Cl. ..... 100/35; 100/4; 100/14; 100/41; 100/42; 100/50; 100/99; 100/218; 100/232; 364/476

[58] Field of Search ..... 100/35, 41, 42, 43, 100/48, 50, 99, 218, 232, 240, 245, 14, 4; 340/679, 680, 686; 364/550, 550.01, 558, 476

[56] References Cited

U.S. PATENT DOCUMENTS

| | | | |
|---|---|---|---|
| 3,750,134 | 7/1973 | Weisend | 340/686 X |
| 4,524,582 | 6/1985 | Lucas et al. | 100/48 X |
| 4,633,720 | 1/1987 | Dybel et al. | 100/99 X |
| 4,637,850 | 1/1987 | Suzuki et al. | 100/218 X |
| 4,729,301 | 3/1988 | Smith et al. | 100/50 X |
| 4,967,652 | 11/1990 | Mally | 100/43 |
| 5,005,394 | 4/1991 | Sartorio et al. | 364/476 X |
| 5,081,922 | 1/1992 | Rudd, Jr. et al. | 100/50 |

FOREIGN PATENT DOCUMENTS

| | | | |
|---|---|---|---|
| 0151198 | 8/1985 | European Pat. Off. | 100/43 |
| 3228559 | 2/1983 | Fed. Rep. of Germany | 100/43 |
| 3241063 | 5/1984 | Fed. Rep. of Germany | 100/43 |
| 58-215300 | 12/1983 | Japan | 100/43 |
| 59-193800 | 11/1984 | Japan | 100/43 |
| 61-242792 | 10/1986 | Japan | 100/50 |

*Primary Examiner*—Stephen F. Gerrity
*Attorney, Agent, or Firm*—Hugh D. Jaeger

[57] ABSTRACT

A baler for recyclable materials and any other materials. The baler includes a power unit. An operator console on a deck at a front of a hopper, which provides for operator observation and operation through a high tech control system. Material is fed into the hopper, such as by a conveyor. A compression chamber under the hopper and a bale chamber is at a forward end of the baler for baling of the materials and subsequent discharge by an ejection ram across a bale run-out table for later disposition. A control system provides the capability of automatic control for the baler, as well as diagnostic assistance when necessary. The baler is also the primary building block for a completely automated municipal recycling facility (MRF). The baler can bale such materials as corrugated cardboard, news print, magazines, computer paper, flattened cans, round cans, plastic bottles, scrap aluminum, scrap copper, aluminum radiators, as well as any other miscellaneous materials required for baling on a real time basis.

9 Claims, 40 Drawing Sheets

Microfiche Appendix Included
(1 Microfiche, 7 Pages)

| ITEM | QTY | DESCRIPTION |
|---|---|---|
| 1 | 2 | 75 HP, 1750 RPM, 365TC MOTOR |
| 2 | 2 | 75 HP DOUBLE PUMP |
| 3 | 2 | 75 HP MOTOR/PUMP CPL'G |
| 4 | 1 | 15 HP, 1750 RPM, 254TC MOTOR |
| 5 | 1 | 15 HP COOLING/STRAPPER PUMP |
| 6 | 1 | 15 HP MOTOR/PUMP CPL'G |
| 7 | 1 | 2" DIRECTIONAL VALVE |
| 8 | 1 | 2" DIRECTIONAL VALVE |
| 9 | 2 | PILOT TANK CHOKE |
| 10 | 2 | 3/4" DIRECTIONAL VALVE |
| 11 | 2 | D06 SUBPLATE W/O RELIEF CART. |
| 12 | 1 | 3/4" C'BALANCE VALVE |
| 13 | 2 | 1 1/2" UNLOADING VALVE |
| 14 | 2 | 1 1/2" CK. VALVE 4-BOLT |
| 15 | 2 | 1 1/4" RELIEF VALVE |
| 16 | 1 | 1 1/4" CK VALVE 4-BOLT |
| 17 | 1 | 1 1/4" INLINE CK VALVE 65# |
| 18 | 2 | 3/8" FLOW CONTROL VALVE |
| 19 | 1 | 3/4" RELIEF VALVE |
| 20 | 3 | 1/4" INLINE CHECK VALVE 3# |
| 21 | 1 | PRESSURE REDUCING VALVE |
| 22 | 1 | HIGH PRESSURE SWITCH |
| 23 | 7 | PRESSURE GUAGE 0-3000 PSI |
| 24 | 1 | VENT VALVE |
| 25 | 1 | D02 SUBPLATE W/O RELIEF |
| 26 | 2 | 1 1/2" BACK PRESSURE CHECK VALVE |
| 27 | 2 | AIR TO OIL COOLER |
| 28 | 1 | 1 1/4" RETURN LINE FILTER |
| 29 | 5 | 3" FILTER/SUCTION STRAINER |
| 30 | 4 | FLOW METER |
| 31 | 1 | PRESSURE TRANSDUCER |
| 32 | 1 | OIL FILTER SWITCH |
| 33 | 1 | LEVEL SWITCH |
| 34 | 1 | TEMPATURE TRANDUCER |
| 35 | 3 | FILTER BREATHER |
| 36 | 1 | HYDRAULIC TANK 120"L X 72"W X 29"D |

FIG. 8G1

| INV. # | PART # |
|---|---|
| D1-019 | CM-4316T |
| G5-038 | 4535V60A30 |
| H2-006 | L-276 |
| D1-009 | CM-2333T |
| G5-048 | 3520V25A08 |
| H2-001 | L-110 |
| G4-054 | DF5S4L168CEW53 |
| G4-064 | DF5S4L166CEWB53 |
| G4-004 | NFDC-LAN-DBT |
| G4-099 | DG5S-8-8C |
| H1-001 | D06 SUBPLATE |
| G4-084 | RCT-06-B1-30 |
| G4-029 | R5U-12-313-15-A1 |
| G4-019 | C5V-12-321-A1 |
| G4-026 | R5V-010-313-12-A1 |
| G4-091 | C5V-103-21 |
| G4-008 | C-2000-30 |
| G4-040 | F-600-S |
| G4-030 | R5V06-31B-12-A1 |
| G4-012 | C-400-5 |
| G4-005 | PBDB-FEN-ECA |
| G0-001 | H-100-95712-612 |
| G0-003 | 7211 |
| G4-038 | DG4S4L-012 |
| H1-013 | D02 |
| G4-083 | LRV15-50 |
| G9-003 | A0-40 |
| G9-031 | RT2-KS7-PP-Y2 |
| G9-013 | SS-300-0 |
| E/G | FT-24NENB-LEA-3 |
| ASHCROFT | MOD K-1 |
| NASON | SP2C-23R/EL |
| G0-012 | L6EPB-BS3A |
| ROSEMOUNT | 244RF001NA |
| G9-032 | ABF 3/10 |
| SELCO | 150 HP TANK |

FIG. 8G2

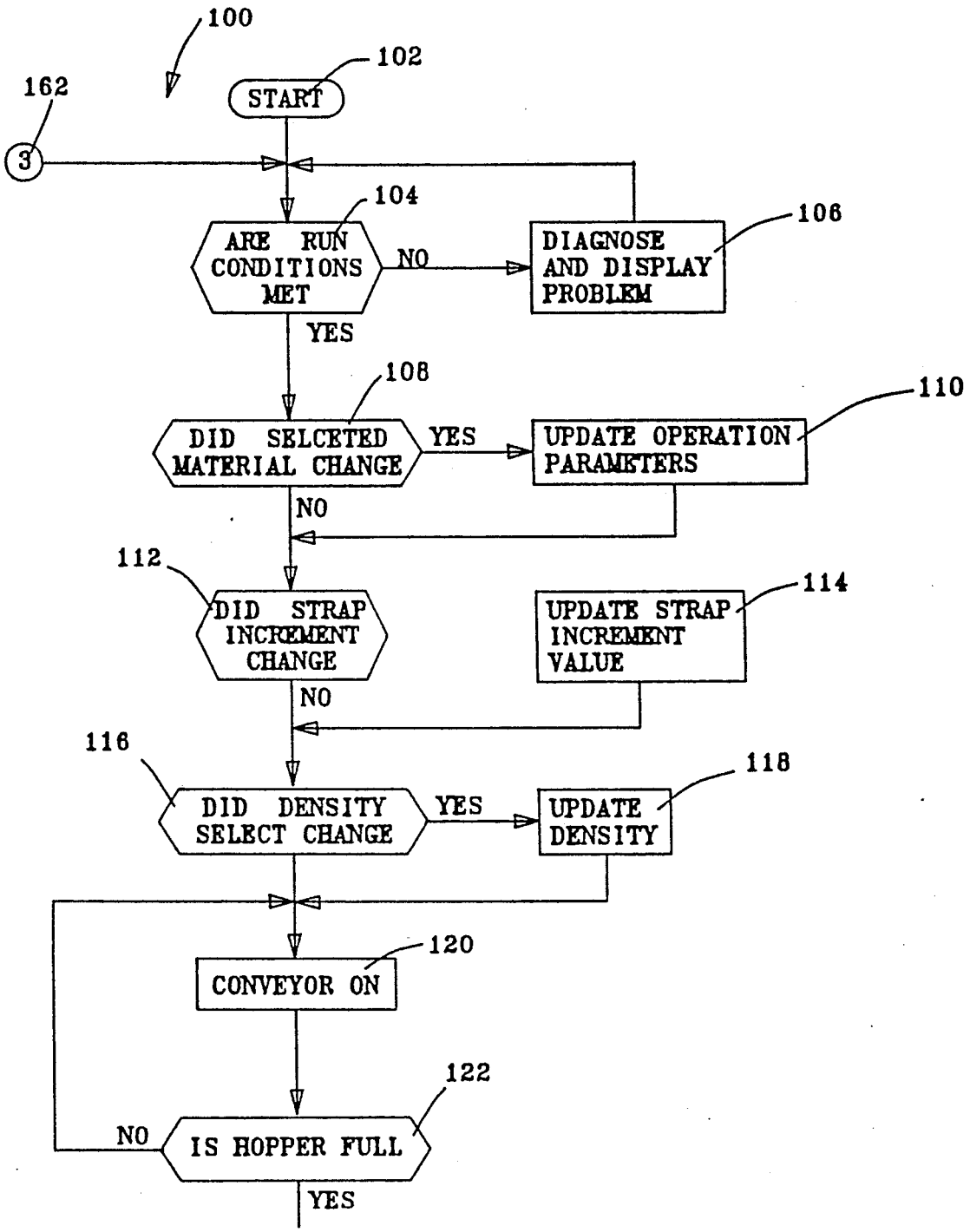
FIG. 10A1

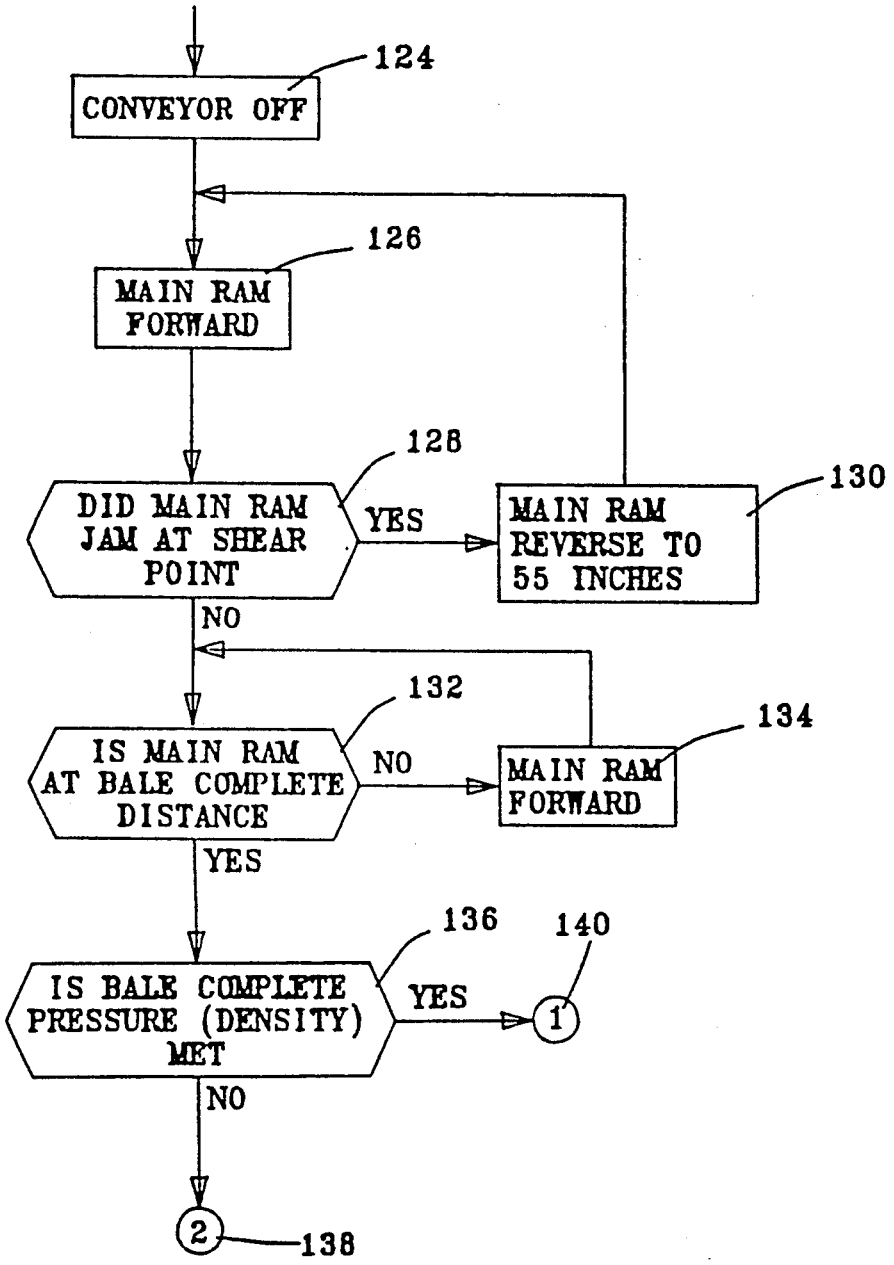
FIG. 10A2

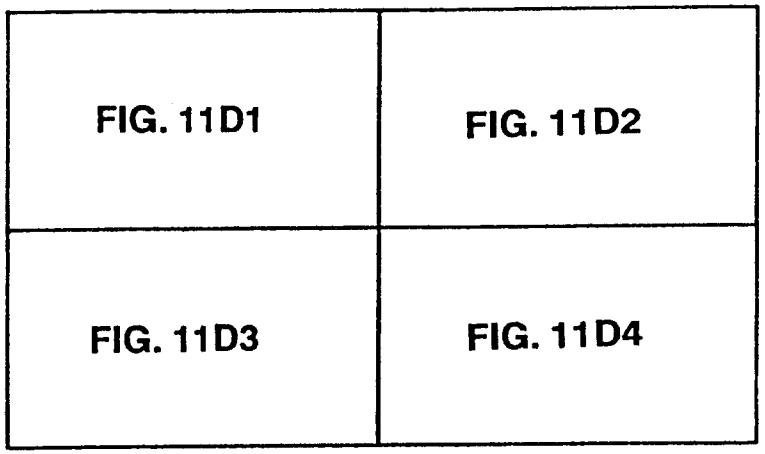
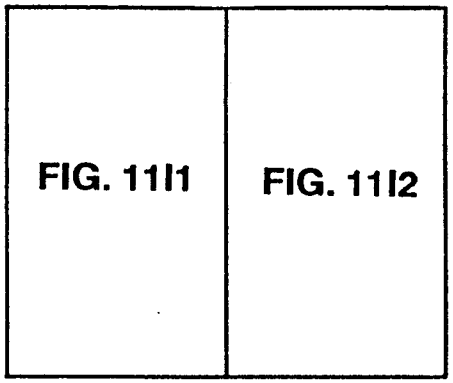
FIG. 11C1

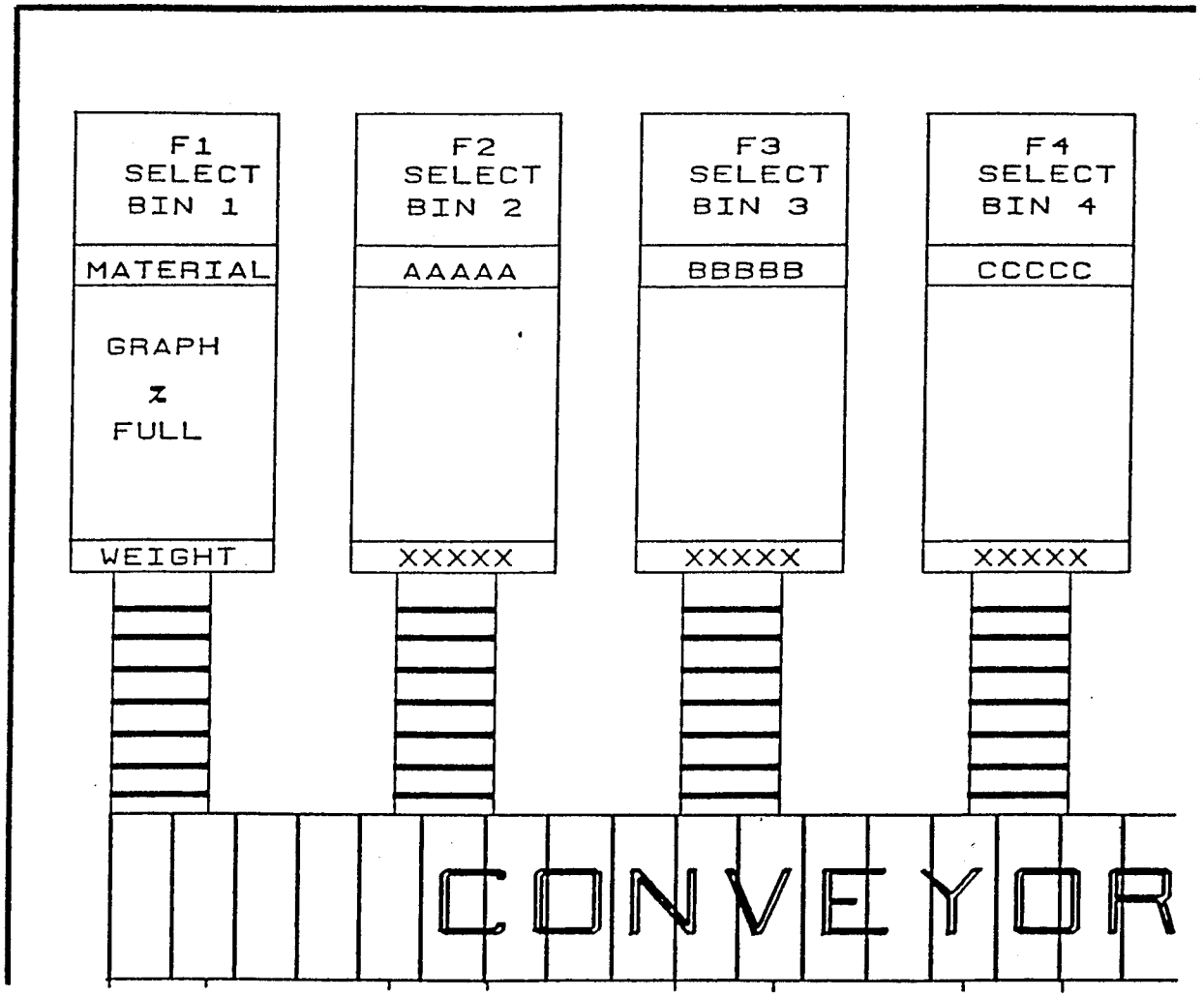
FIG. 11D1

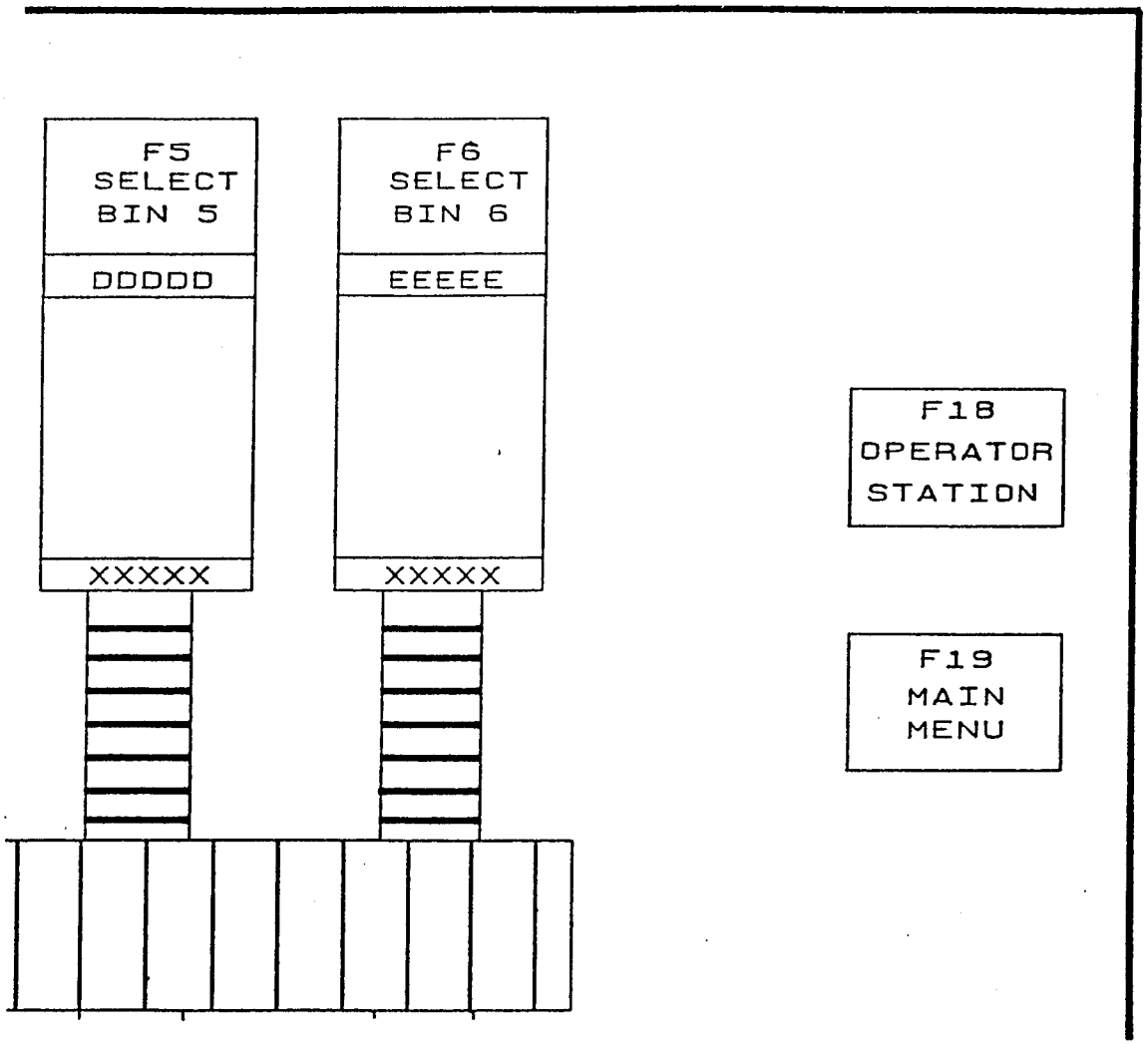
FIG. 11D2

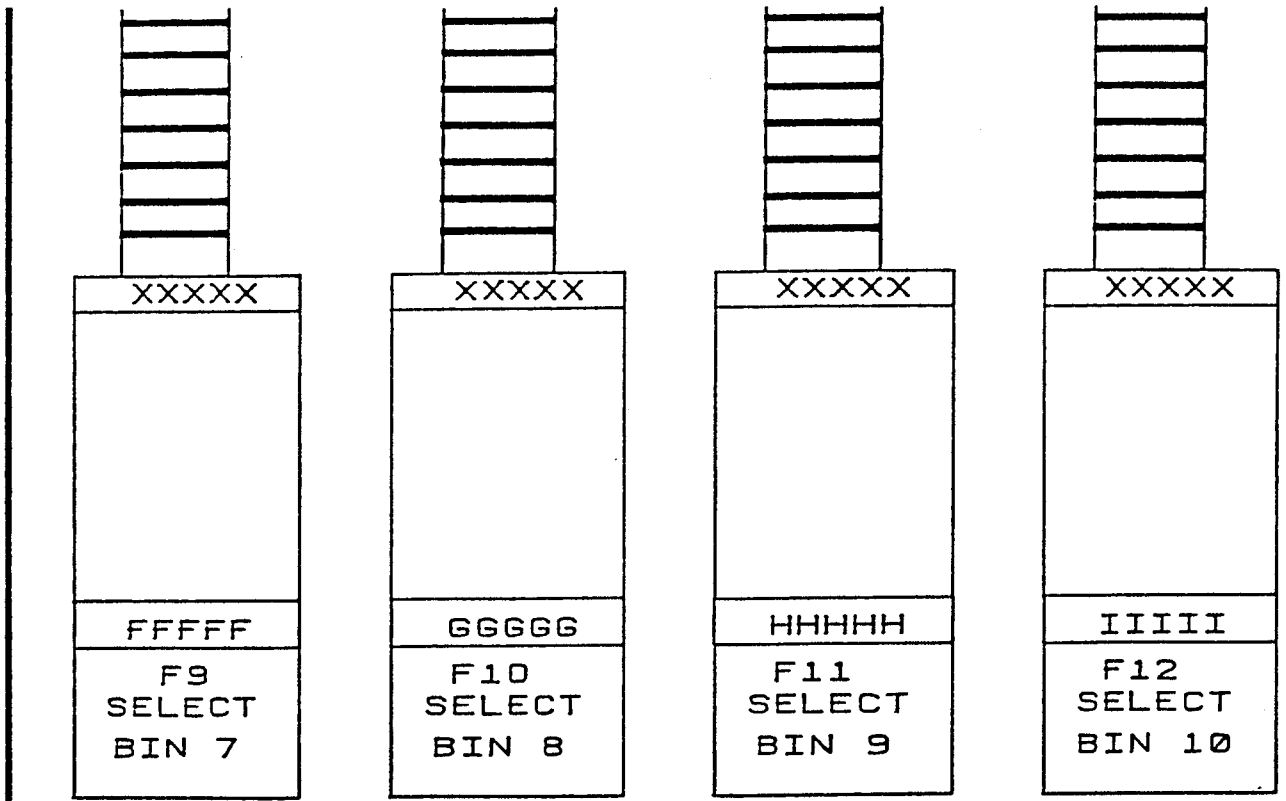
FIG. 11D3

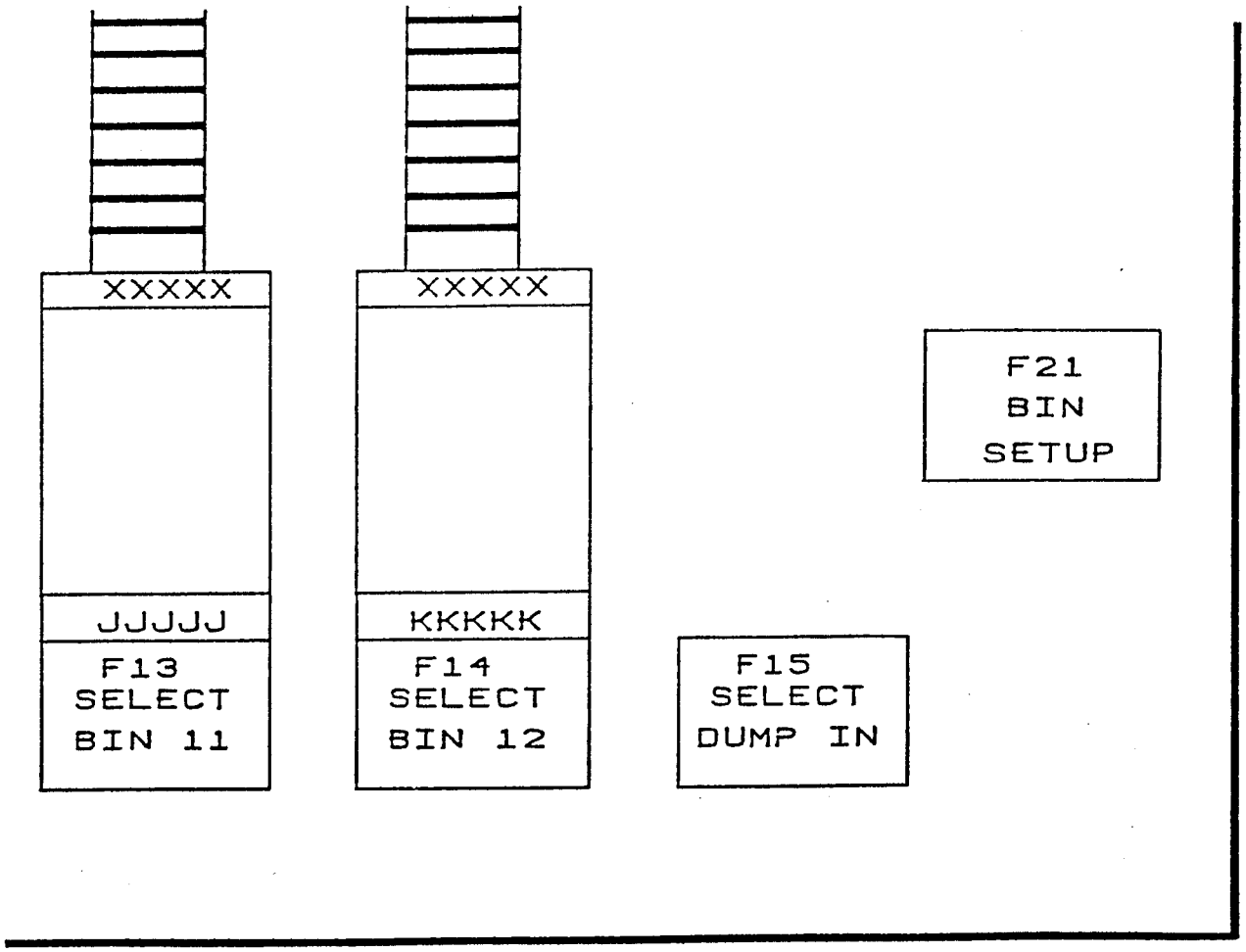
FIG. 11D4

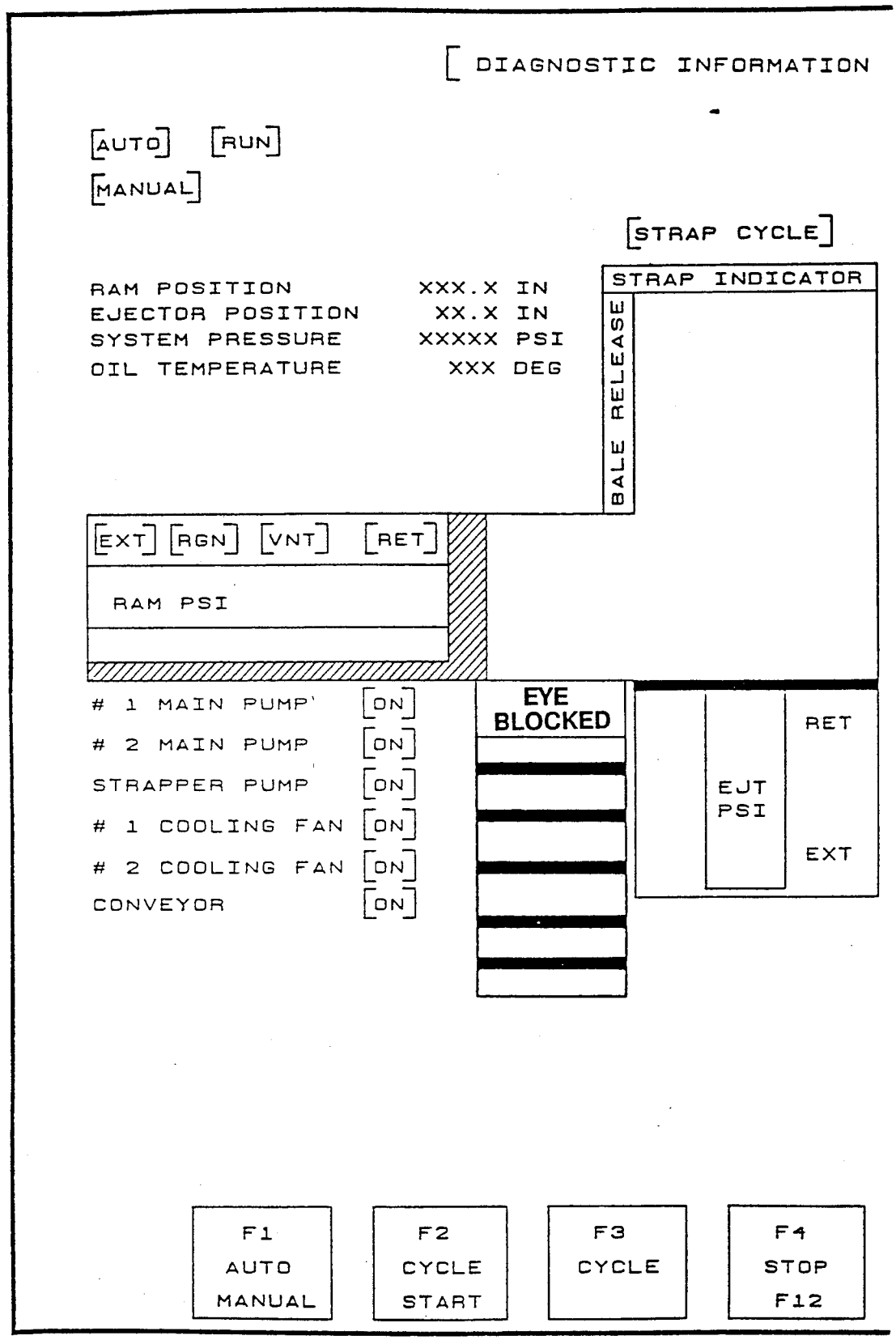
FIG 11I2

CONTROLLER FOR MATERIAL BALER

Microfiche Appendix on 1 fiche, 7 pages.

CROSS REFERENCES TO CO-PENDING APPLICATIONS

U.S. Pat. application Ser. No. 07/683,560 (pending), filed on even date and entitled "Baler" is commonly assigned to the Assignee of the present invention and incorporated herein by reference.

BACKGROUND OF THE INVENTION

1. Field of the Invention

The present invention is a baler for baling of materials for subsequent recycling or disposition, and more particularly, pertains to a baling system which is automated, and requires a trained operator in the area of the baler. The baler can also be operated in a manual mode of operation.

2. Description of the Prior Art

Prior art balers have been physically bulky devices requiring time consuming adjustments, as well as manual operation by a skilled operator.

The operator usually had to be trained to figure out how to operate the baler, and also constantly monitor the baling operation. Often, it was difficult for the operator to see a charging operation of materials. The operator was not always able to observe the materials being charged by the ram into the compression chamber. The operator may not have had a full and complete view of charging operation of the ram pushing materials into the compression chamber for forming of a bale.

Finally, an operator had to be trained in knowing the types of materials being baled and how the baler would bale these types of materials. It was an operator-intensive task and required complete operator attention to the adjusting of pressure settings for the gatherer ram to compensate for the baling of different materials.

Prior art balers usually required adjusting a hydraulic pressure switch to achieve a consistent desired density. The prior art balers also usually required that newspapers be baled in a manual mode of operation as newspapers are one of the hardest materials to bale because of density requirements, etc.

Repair of prior art balers usually required tools, as well as a volt-ohm-meter for electrical, electromechanical or electrooptical components. The prior art balers did not display or exhibit any diagnostic messages such as faults, or to take a remedial action.

The present invention overcomes the disadvantages of the prior art by providing a baler which is state-of-the-art, energy efficient, automated, computer controlled and includes a video display.

SUMMARY OF THE INVENTION

The general purpose of the present invention is a state-of-the-art baler with a control system for baling of materials, such as recyclable materials. The baler is computer assisted, and can be operated by one trained operator who is able to control the baler operations for different types of materials, as well as observing the baler operation. The baler system is energy efficient and provides for trained operator control of the baler operations. The conveyor can feed materials into a hopper for subsequent baling.

According to one embodiment of the present invention, there is provided a baler with a main power unit, a compression ram, a compression chamber, a bale chamber with an ejector ram, a bale release door, and wire tier with separate power unit or by the main power unit for controlling the compression ram and the ejector ram. An operator stands at a control station to initiate baler operations from a computer-assisted control station. The computer, such as a programmable controller, includes a plurality of algorithms for the baling of different materials at different densities and having varying strapping distances. The computer also generates video displays for operation, maintenance, diagnostics and report generation. The control station can be located at the front or rear of the hopper. The forward end of the hopper is adjacent an ejector ram for ejecting a bale from the bale chamber. Materials are fed into the hopper. The baled material is ejected by the ejector ram and can be disposed of in any fashion, such as on a bale run-out table, by conveyor, or by a forklift from the bale run out table, etc.

Significant aspects and features of the present invention include a baler which is computer assisted and user friendly. The baler is also efficient in operation, providing that an operator can view most aspects of baler operations, as well as monitor the status of the power units, pressures, solenoids, and other hydraulic and electrical operations. The operator is in complete control of baler operations, and is able to view operating components during the baler operations, such as the compression ram, the hopper and the material being fed or conveyed into the hopper.

Another significant aspect and feature of the present invention is a baler which can bale different types of materials, especially recyclable materials. The operator can easily compensate for different types of materials being baled.

Additional significant aspects and features include a baler which is energy efficient and operator friendly. The baler is energy efficient and derives its hydraulic power from an adjacent main power unit. A separate power unit can be provided for the wire tier for the baler.

Having thus described some of the embodiments of the present invention, it is the principal object hereof to provide a baler which is energy efficient, operator friendly and cost effective for baling of materials on a real time basis and flow through the hopper, through the charging box, into the compression chamber, and for subsequent ejection as a strapped bale by an ejector ram.

One object of the present invention is a baler which is readily controlled by an operator through a computer-assisted operator control station, which is adjacent to the hopper so that the operator has real time control and observation basis for baler operations.

Another object of the present invention is to provide a baler which bales material flowing toward the operator, providing for rapid change-over between different types of materials, such as recyclable materials. This is especially important for baling of recyclable materials, where some of the quantities may be small, but it is desirous to efficiently change over from one type of material to another type of material on the flow.

A further object of the present invention is the baling of these types of recyclable materials, such as corrugated materials, news print, magazine papers, computer papers, flattened cans, round cans, plastic bottles, scrap aluminum, scrap copper, aluminum radiators, and other miscellaneous materials too numerous to mention, and certainly within the scope and teachings of the present invention and not limiting of the present invention.

BRIEF DESCRIPTION OF THE DRAWINGS

Other objects of the present invention and many of the attendant advantages of the present invention will be readily appreciated as the same becomes better understood by reference to the following detailed description when considered in connection with the accompanying drawings, in which like reference numerals designate like parts throughout the figures thereof and wherein:

FIGS. 8A-8G2 illustrate the hydraulic schematic diagram;

FIGS. 10A2-10C illustrates the flow charts for the operation of the electrical circuit and the PLC of FIGS. 9A-9J; and, FIGS. 11A-11I2 illustrate video displays on the video screen of the operator console 20 as generated during operation of the baler 10.

FIG. 11C1 indicates the alignment of FIGS. 11D1-11D4 and of FIGS. 11I1 and 11I2.

DESCRIPTION OF THE PREFERRED EMBODIMENTS

Figure 1:
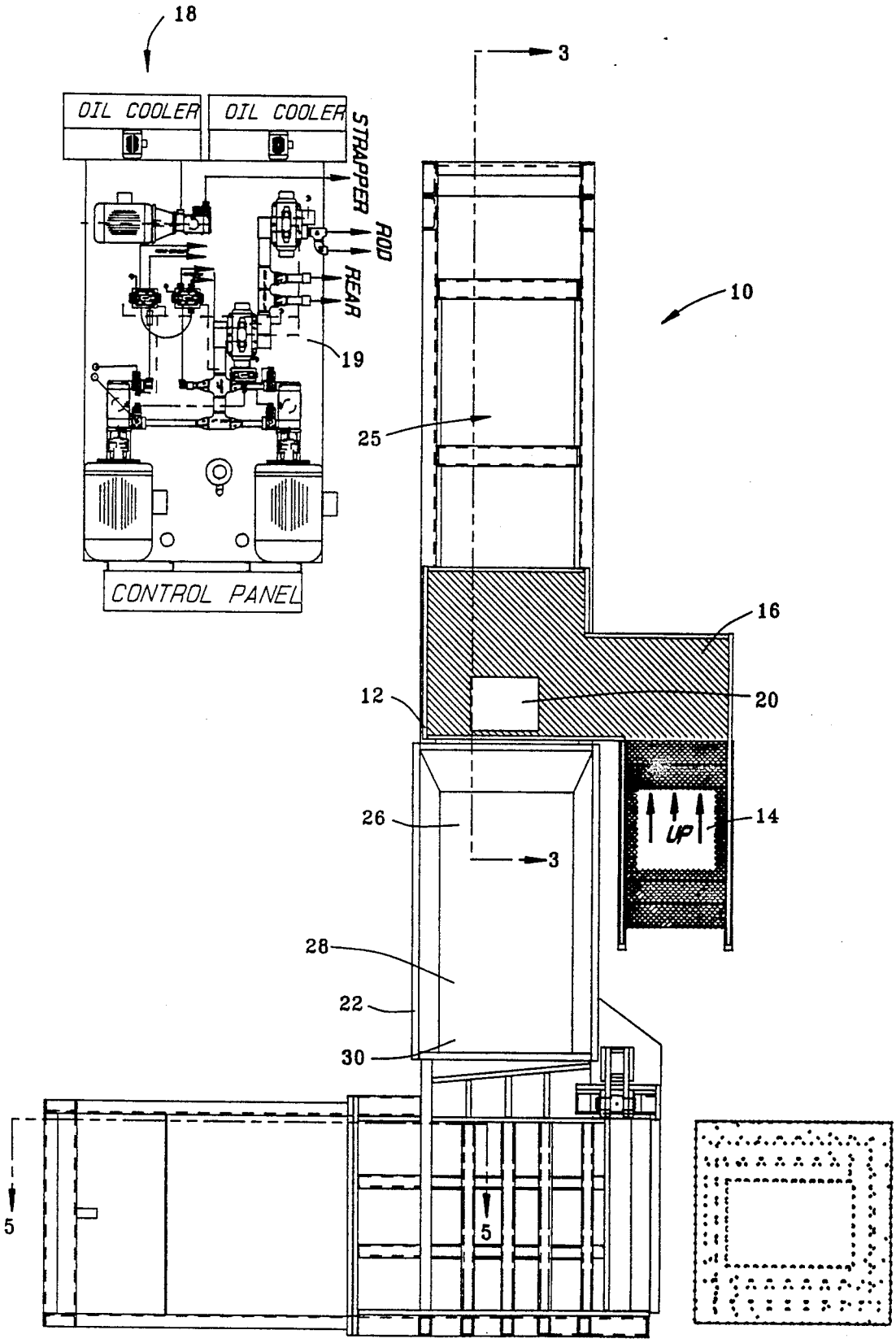
FIG. 1 illustrates a top view of a baler, the present invention.

FIG. 1 illustrates a top view of a baler 10, the present invention. The baler 10 includes a framework support structure 12 upon which numerous component members are secured and attached, and secures to a slab or a pad. Stairs 14 and a gathering deck 16 align and secure to the upper portion of the framework support structure 12. A power unit 18 mounts on a frame 19. A high-tech control station, also known as an operator's console 20, positions on the gathering deck 16. A hopper 22 with hopper extensions 24 align to the front of the gathering deck 16. Several chambers, including a compression ram area 25, a charging box chamber 26, a bale compression chamber 28, and a bale exit chamber 30 align horizontally with respect to each other, and position generally beneath the gathering deck 16, below or adjacent the hopper 22 as illustrated. Material to be baled loads in the hopper 22, and is fed by gravity into the charging box chamber 26. A compression cylinder 32 and an intensifier cylinder 34 align in the compression ram area 25 to power the compression ram 36, which forcibly moves the material to be baled from the charging box chamber 26 into the bale compression chamber 28. After material is compressed, an ejection cylinder 38 shown in dashed lines and an ejection ram 40 ejects the bale.

The power unit 18 on the power unit frame includes a number of connected components, including a hydraulic reservoir box, motors and staged pumps as later described in FIGS. 8A-1G2. Hydraulic manifolds connect to the staged pumps, filters and cooling fans. A plurality of manifold hoses connect to the compression cylinder, the ejection cylinder, the bale release cylinder and the wire strapper.

The compression cylinder 32 aligns and secures in the compression ram area 25, and secures on the outboard end of the deck. The inboard end of the compression cylinder 32 secures to the framework support structure 12. The compression ram 32 is generally of an open rear box shape which secures to the compression cylinder 32. The upper leading edge of the compression ram 36 includes a compression ram knife. A shear knife extends across the structure.

A charging box chamber 26 aligns beneath the hopper 22, and includes a left charging box side frame **26*a* and a right charging box side frame 26*b*. A charging box flange 72 extends perpendicularly and outwardly from the top of the right charging box side frame 26*b*. A plurality of hold down adjustors 74*a*-74*n* secure and align to the charging box flange 72** to adjust a hold down bar as later described in detail.

Viewing assemblies 42 and 44, such as Lexane, locate on inboard walls of the hopper extensions 24 so that the operator can visually view and monitor the interior of the hopper 22 and the charging box chamber 26.

The physical structure of the baler 10 is sold under the name of "Selco Systems-II Hy-density Two Ram Baler" by Selco of Baxley, Georgia, the assignee of this patent application.

Figure 2:
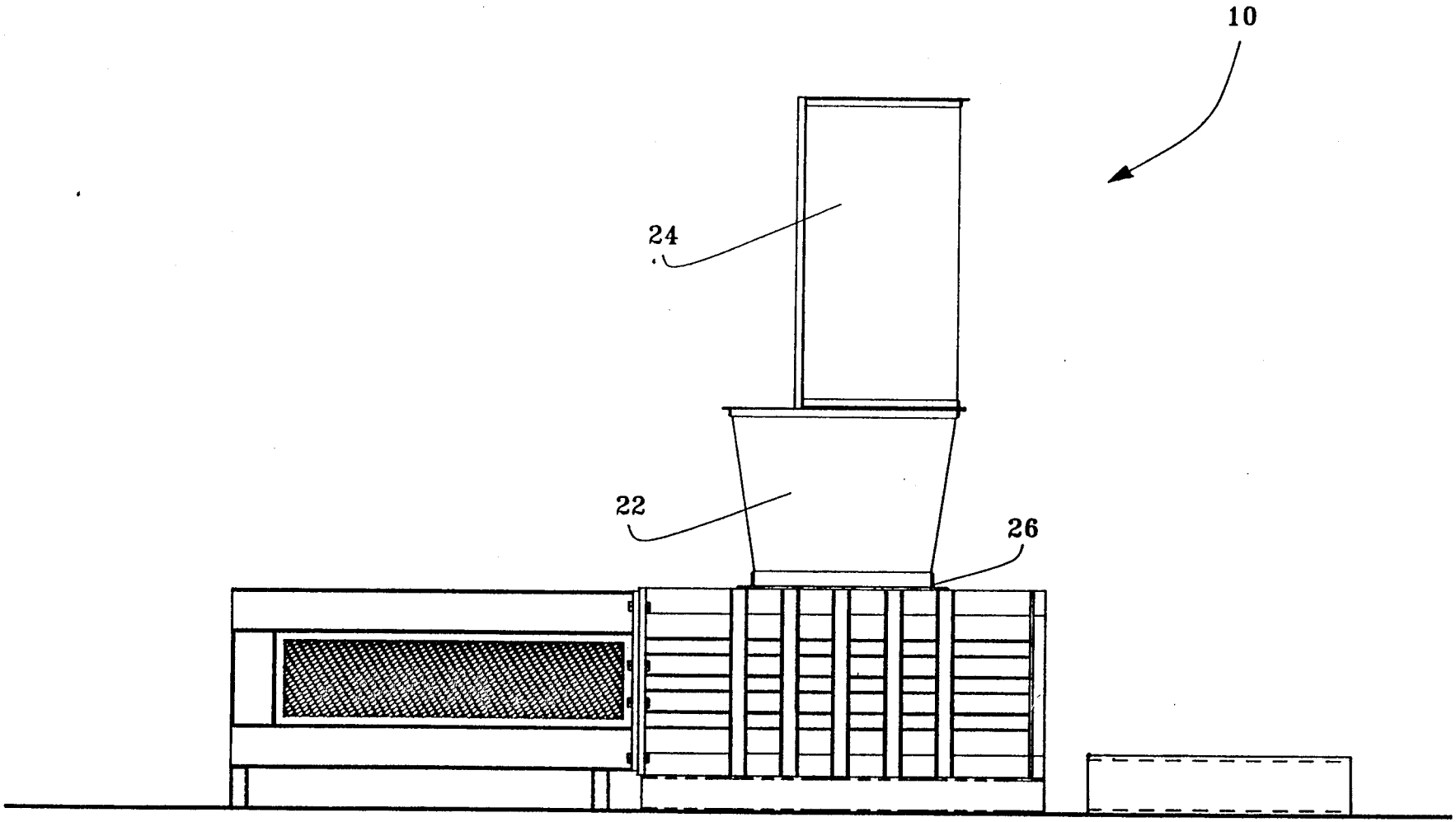
FIG. 2 illustrates an end view of the baler.

FIG. 2 illustrates an end view of the baler 10 where all numerals correspond to those elements previously described.

Figure 3:
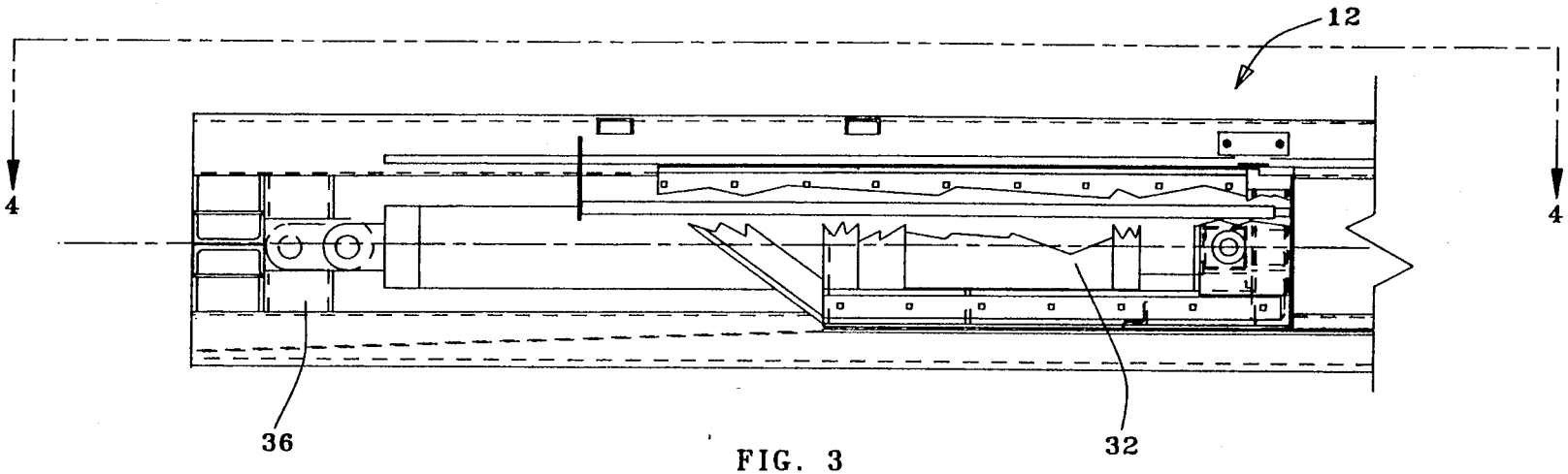
FIG. 3 illustrates a view taken along line 3—3 of FIG. 1.

FIG. 3 illustrates a view taken along line 3—3 of FIG. 1 where all numerals correspond to those elements previously described.

Figure 4:
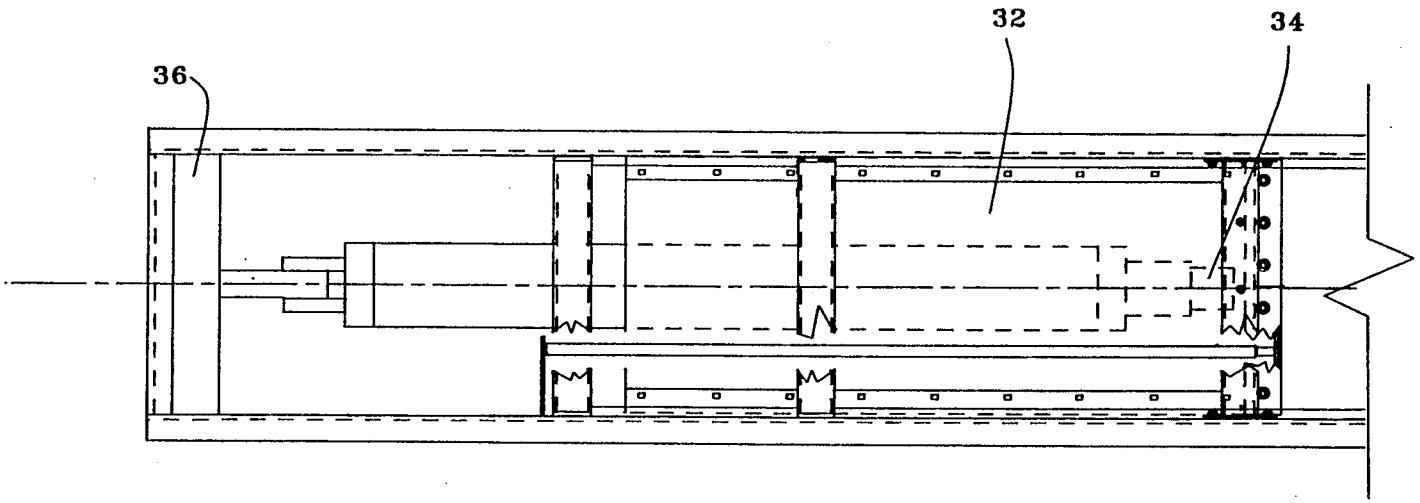
FIG. 4 illustrates a view taken along line 4—4 of FIG. 3.

FIG. 4 illustrates a view taken along line 4—4 of FIG. 3 where all numerals correspond to those elements previously described.

Figure 5:
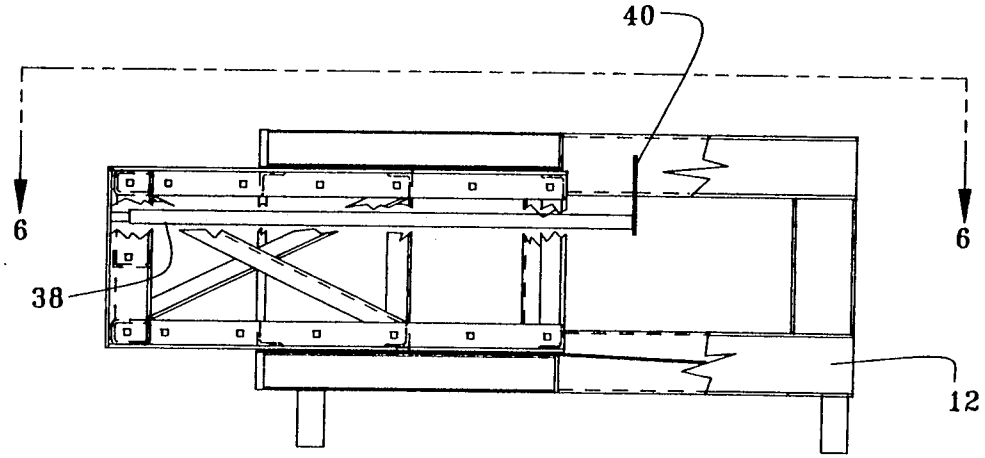
FIG. 5 illustrates a view taken along line 5—5 of FIG. 1.

FIG. 5 illustrates a view taken along line 5—5 of FIG. 1 where all numerals correspond to those elements previously described.

Figure 6:
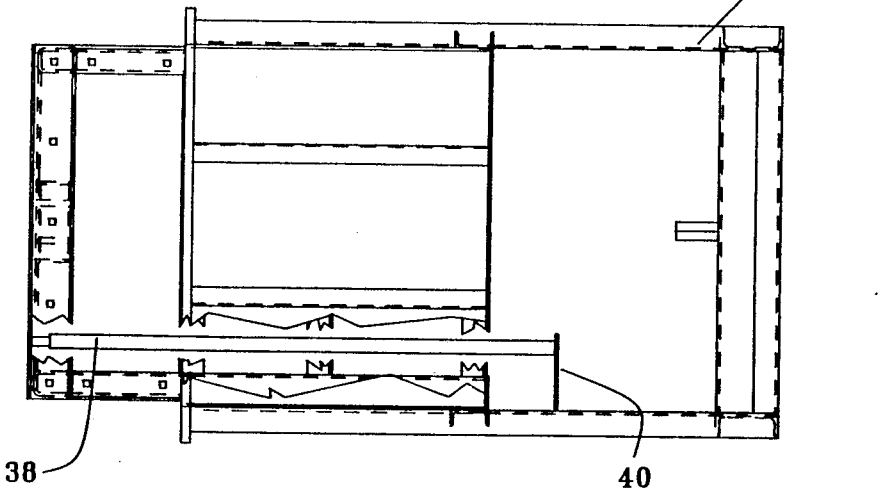
FIG. 6 ,illustrates a view taken along line 6—6 of FIG. 5.

FIG. 6 illustrates a view taken along line 6—6 of FIG. 5 where all numerals correspond to those elements previously described.

Figure 7:
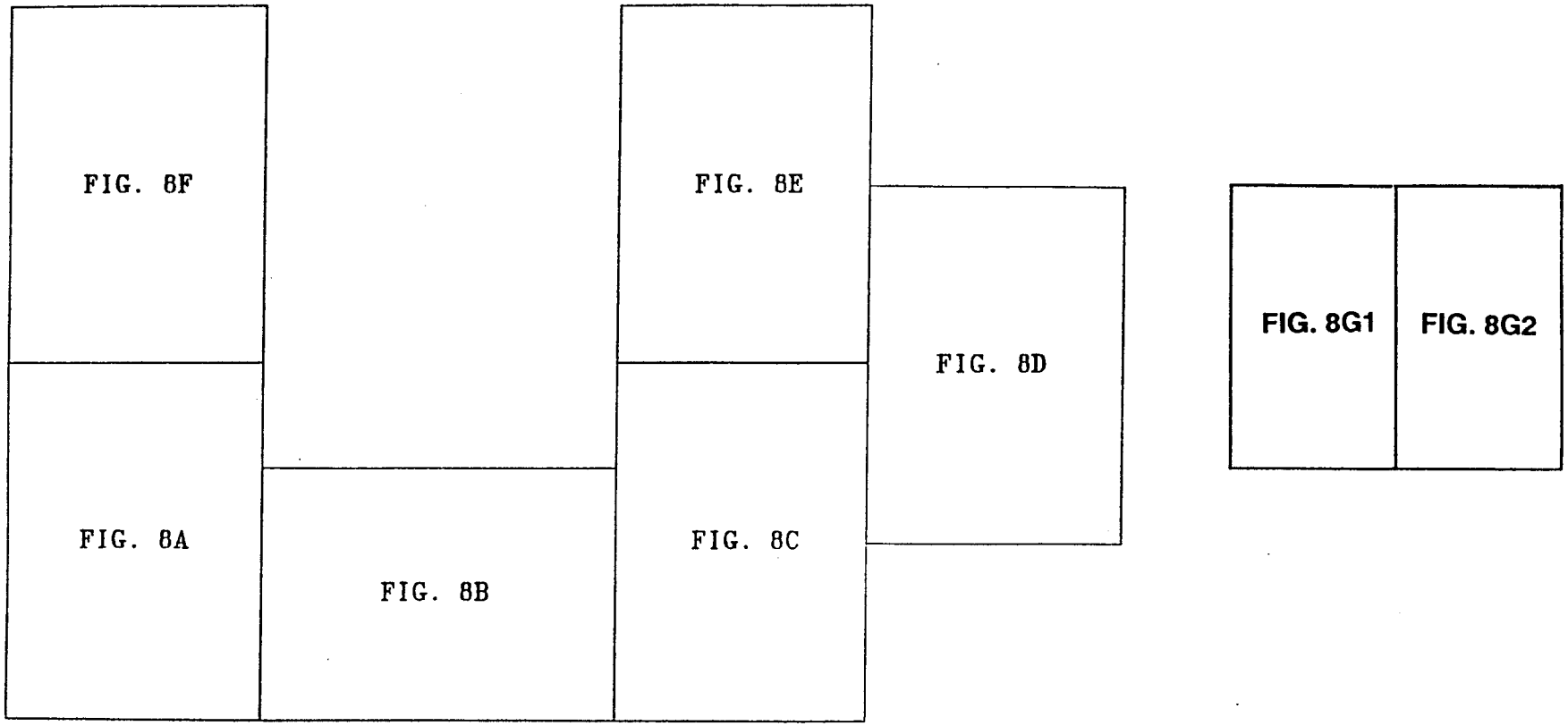
FIG. 7 illustrates the arrangement of the sheets for FIGS. 8A-8G2.
Figure 8A:
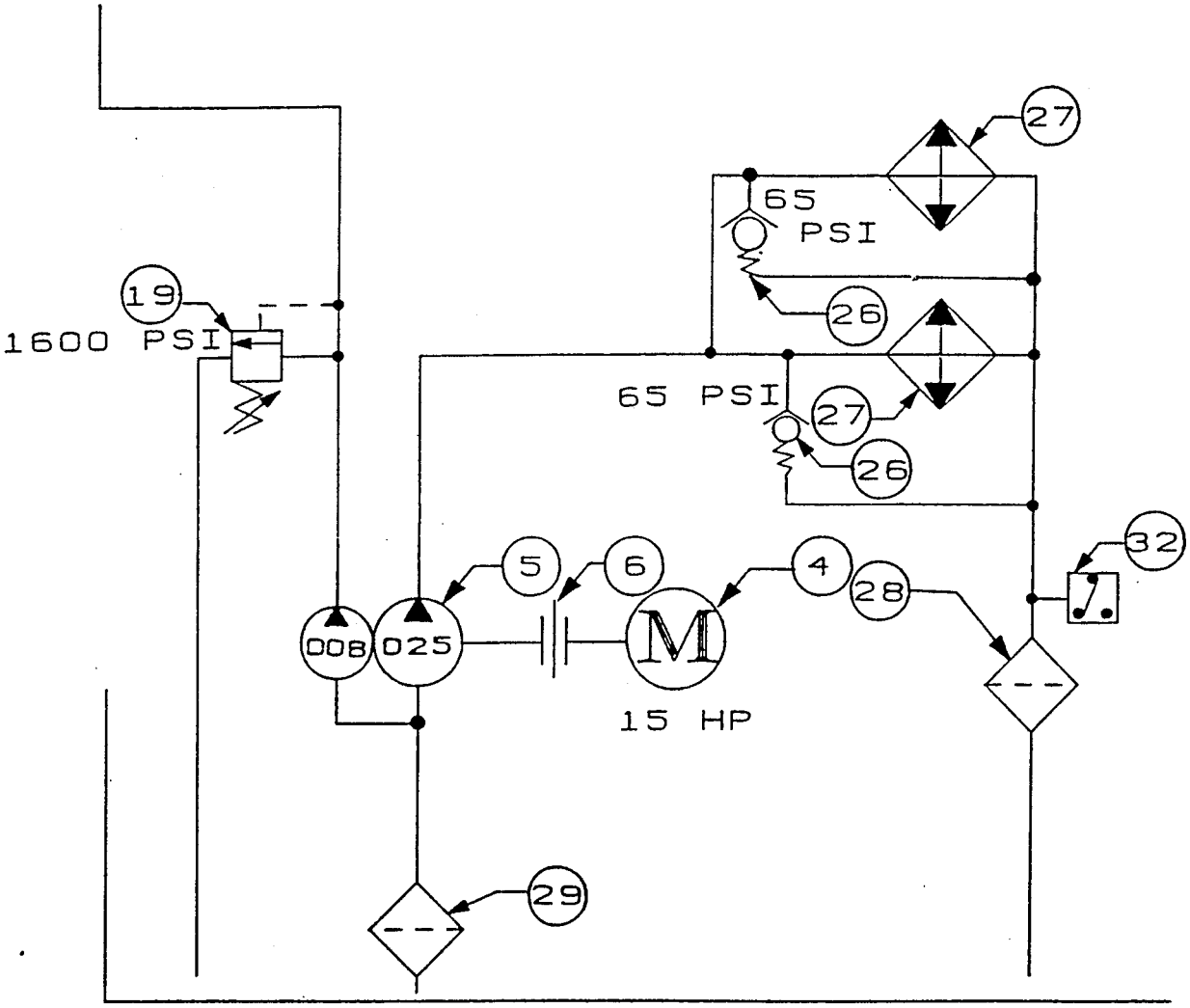
Figure 8B:
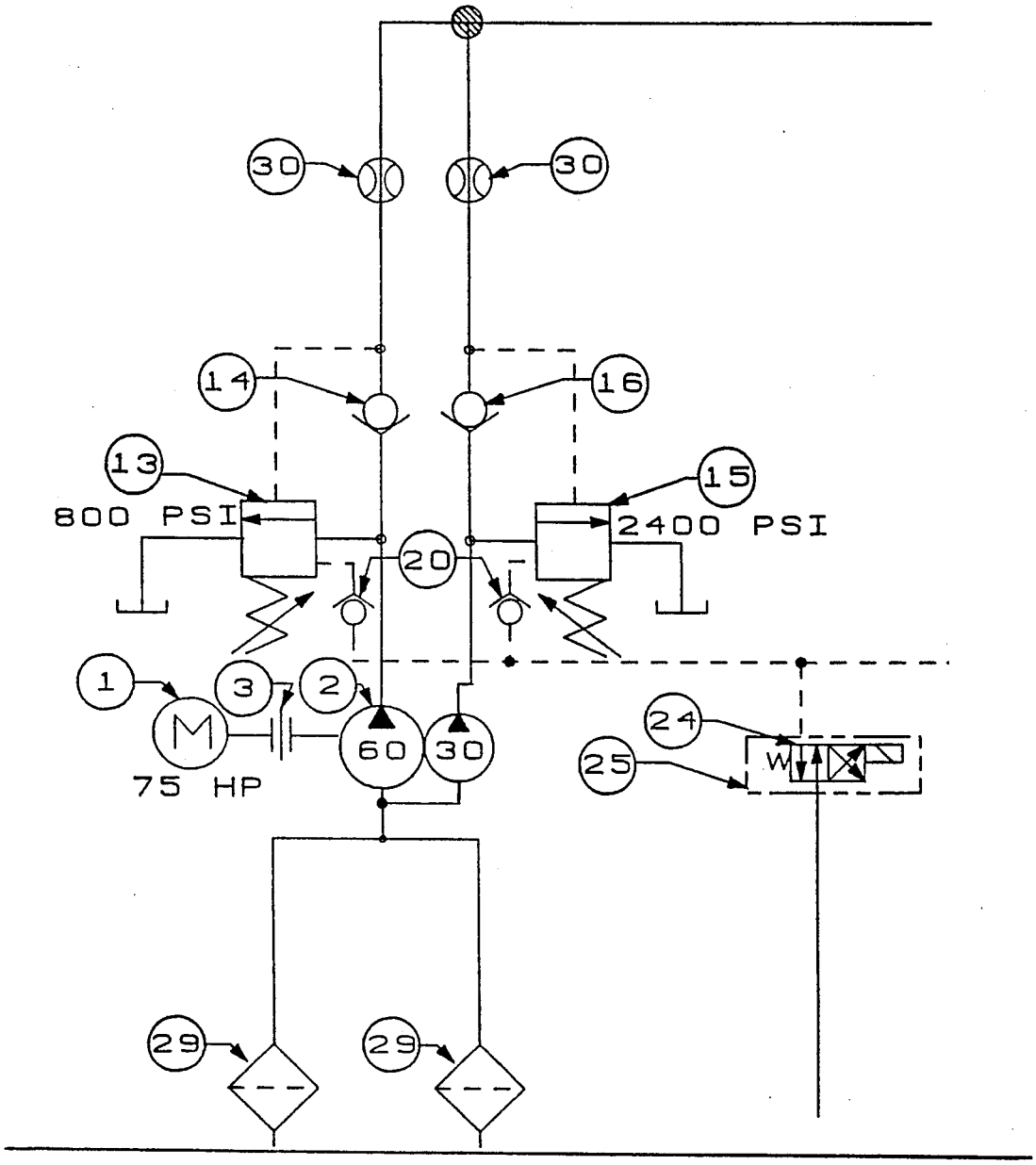
Figure 8C:
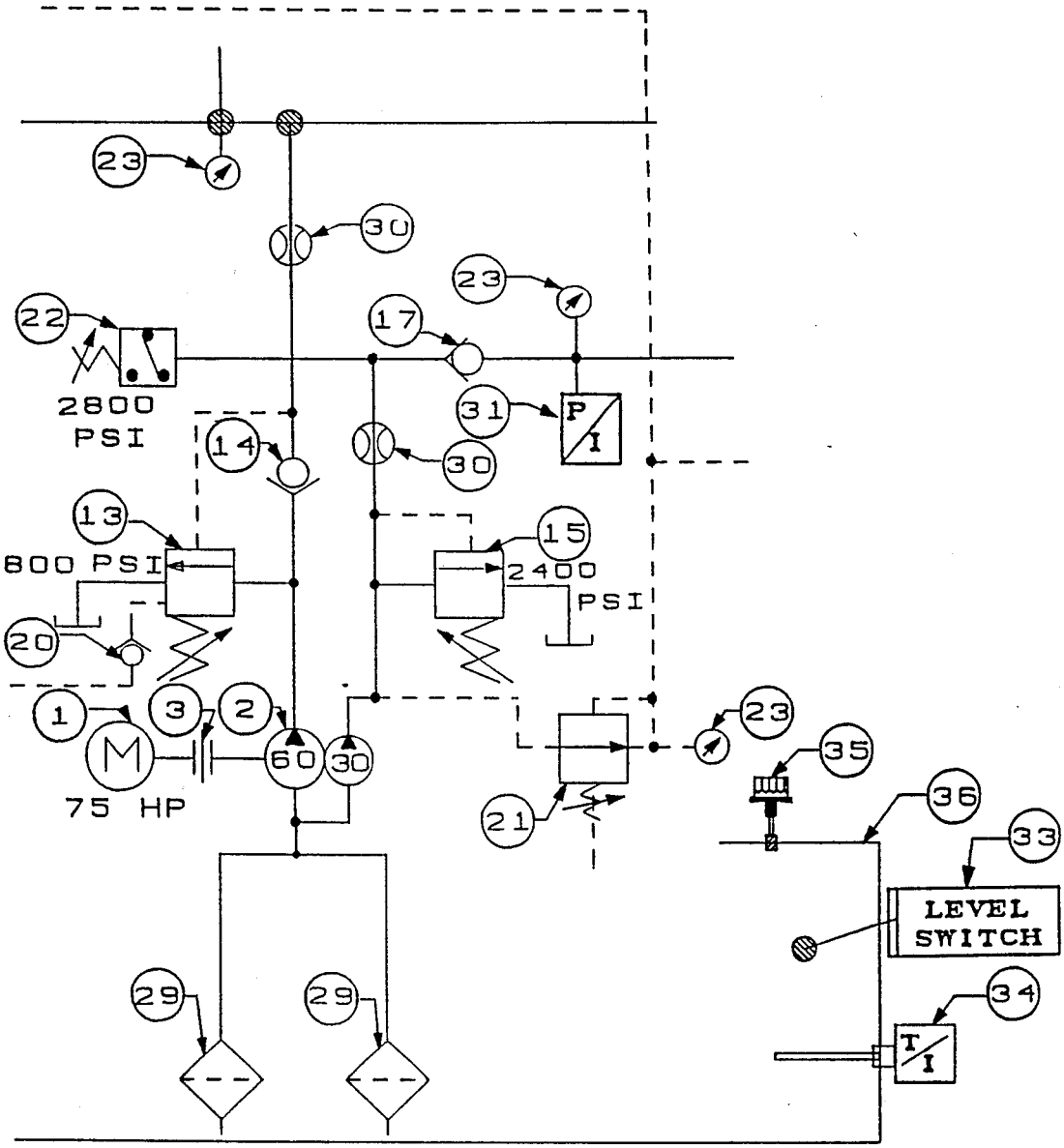
Figure 8D:
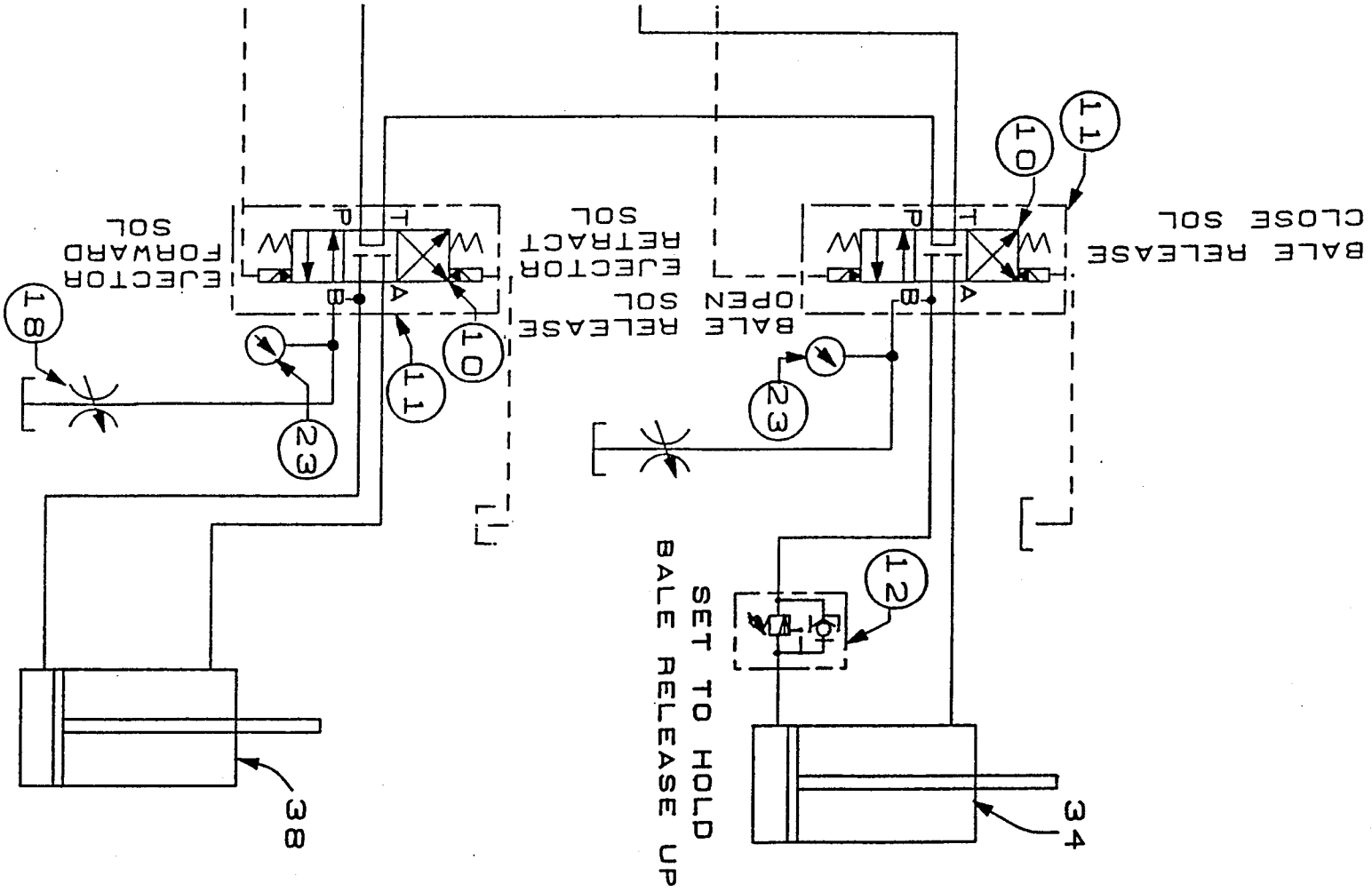
Figure 8E:
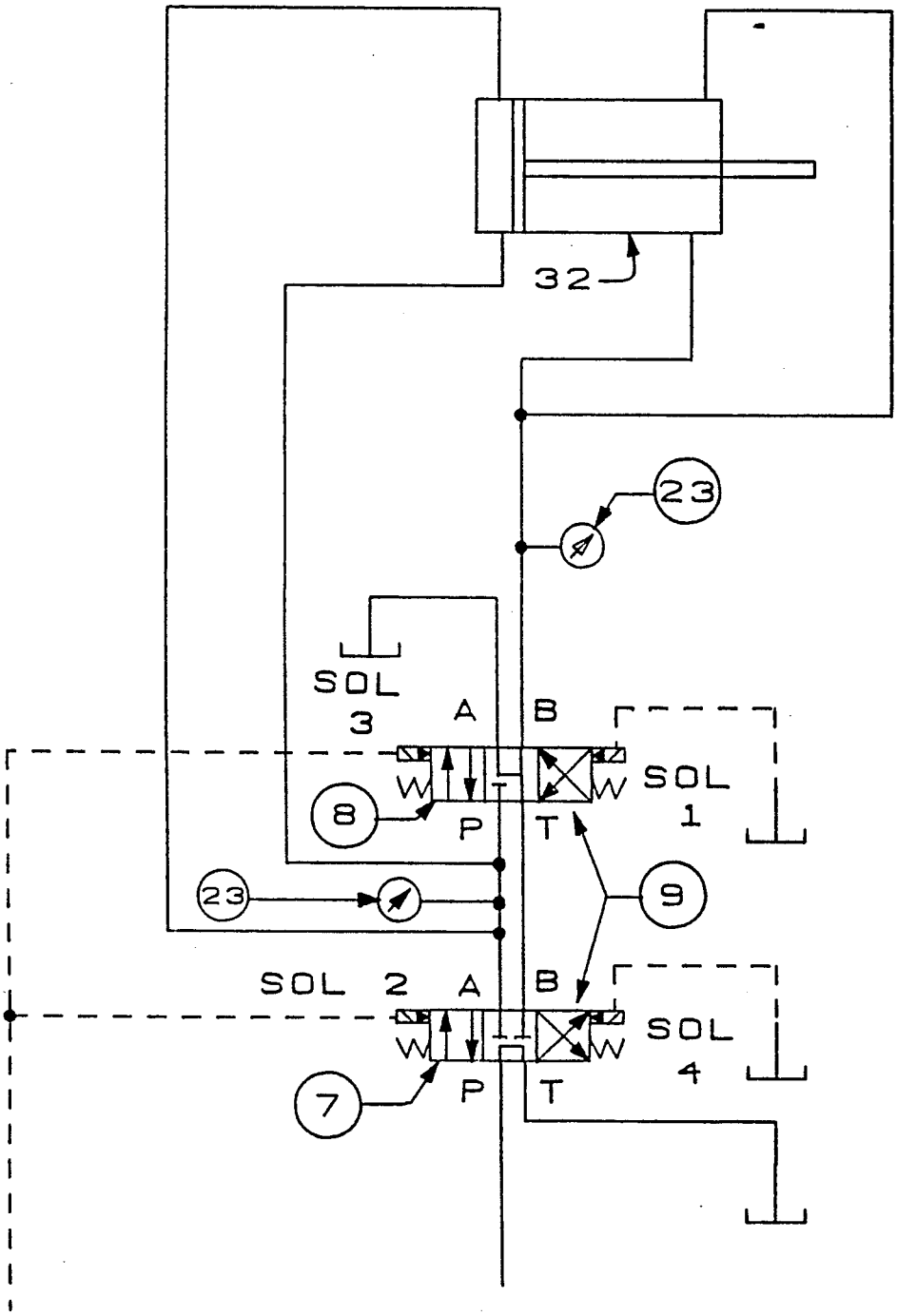

FIG. 7 illustrates the arrangement of the sheets for FIGS. 8A-8G2.

FIGS. 8A-8G2 illustrate the hydraulic schematic diagrams corresponding to the power unit 18 and the related hydraulic circuits for hydraulically powering and controlling the baler 10 and including the transducers and flow meters which connect to the programmable controller as later described in detail.

Figure 8F:
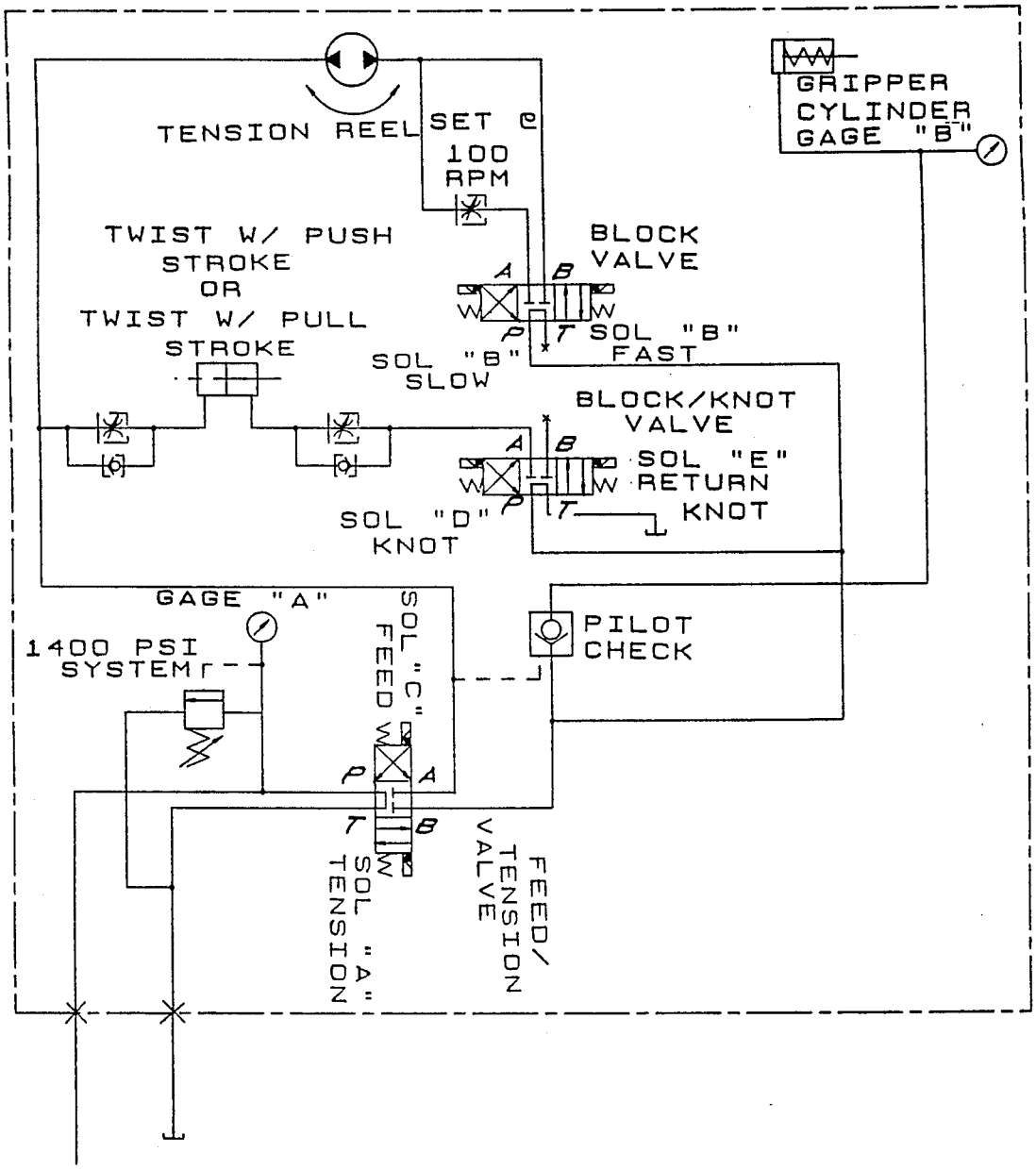

FIG. 8F illustrates the hydraulic schematic diagram for a strapper.

FIG. 8G1-8G2 illustrates the parts nomenclature corresponding to FIGS. 8A-8E.

The EKG flow meters sense the flow of hydraulic fluid.

FIGS. 9A-9J illustrate the electrical schematic and electrical connections for the baler 10.

Figure 9A:
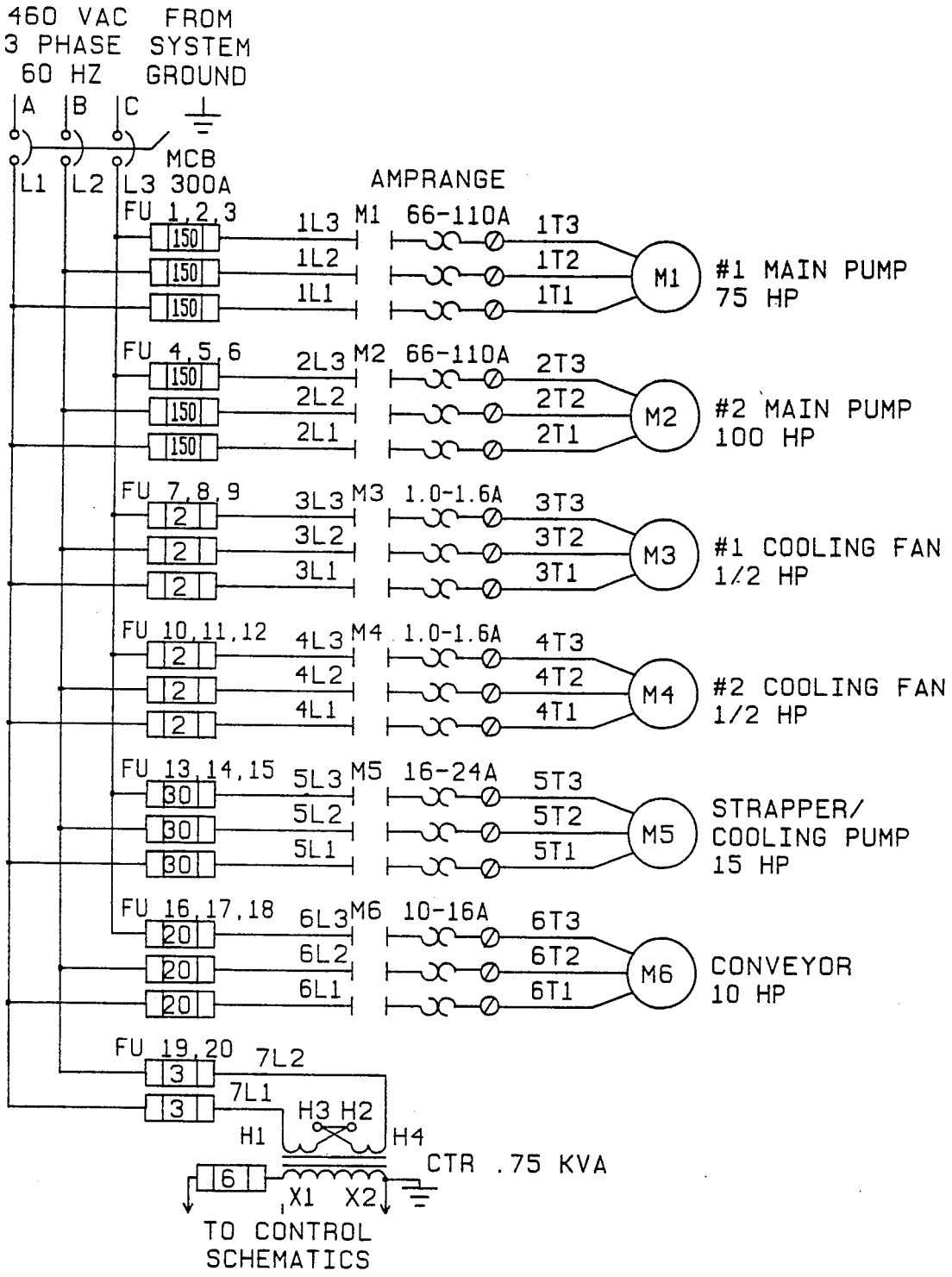
FIGS. 9A-9J illustrate the electrical schematic and electrical connections for the baler.

FIG. 9A is for motor connections of the baler.

Figure 9B:
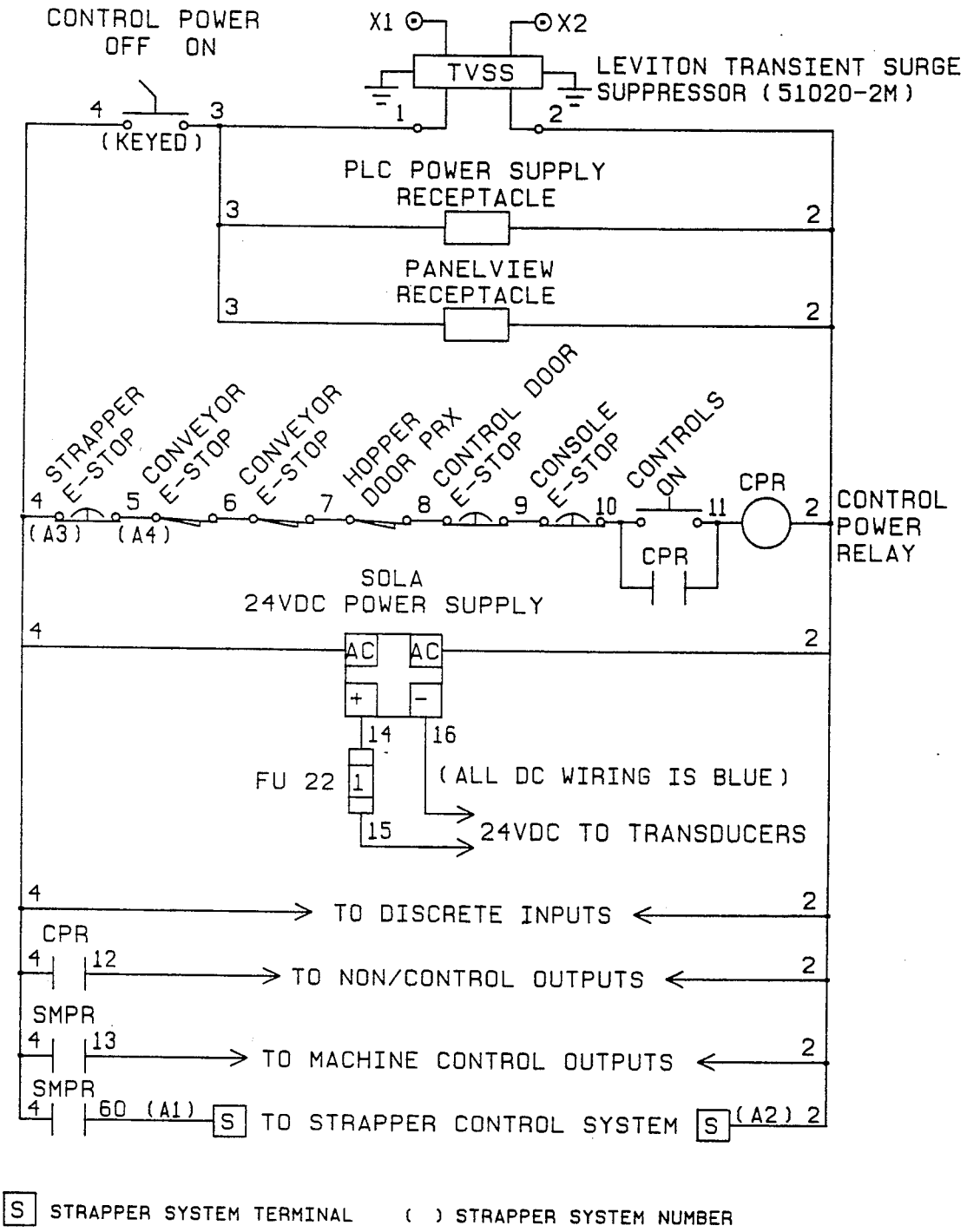

FIG. 9B is for start up of the baler.

Figure 9C:
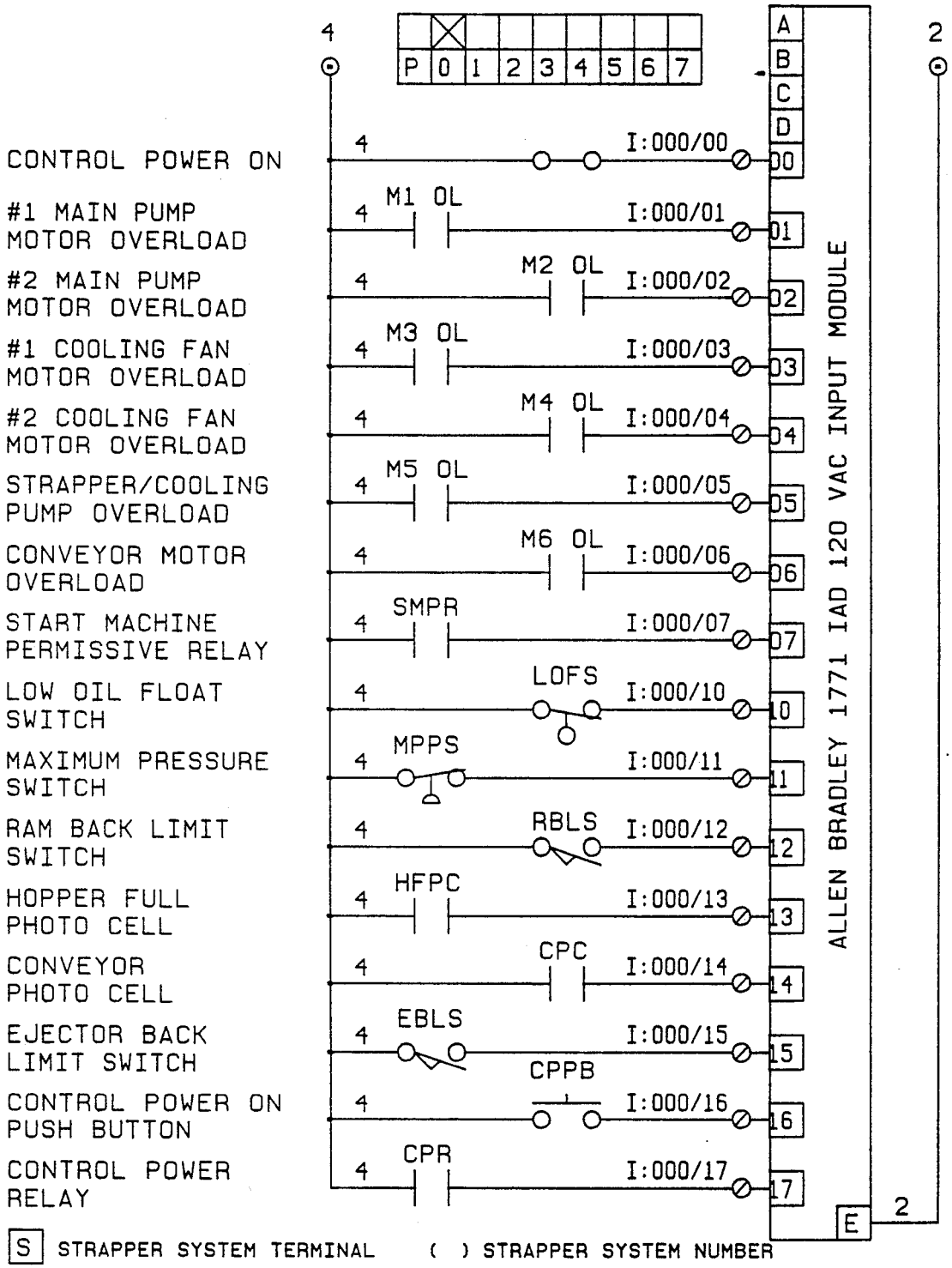
Figure 9D:
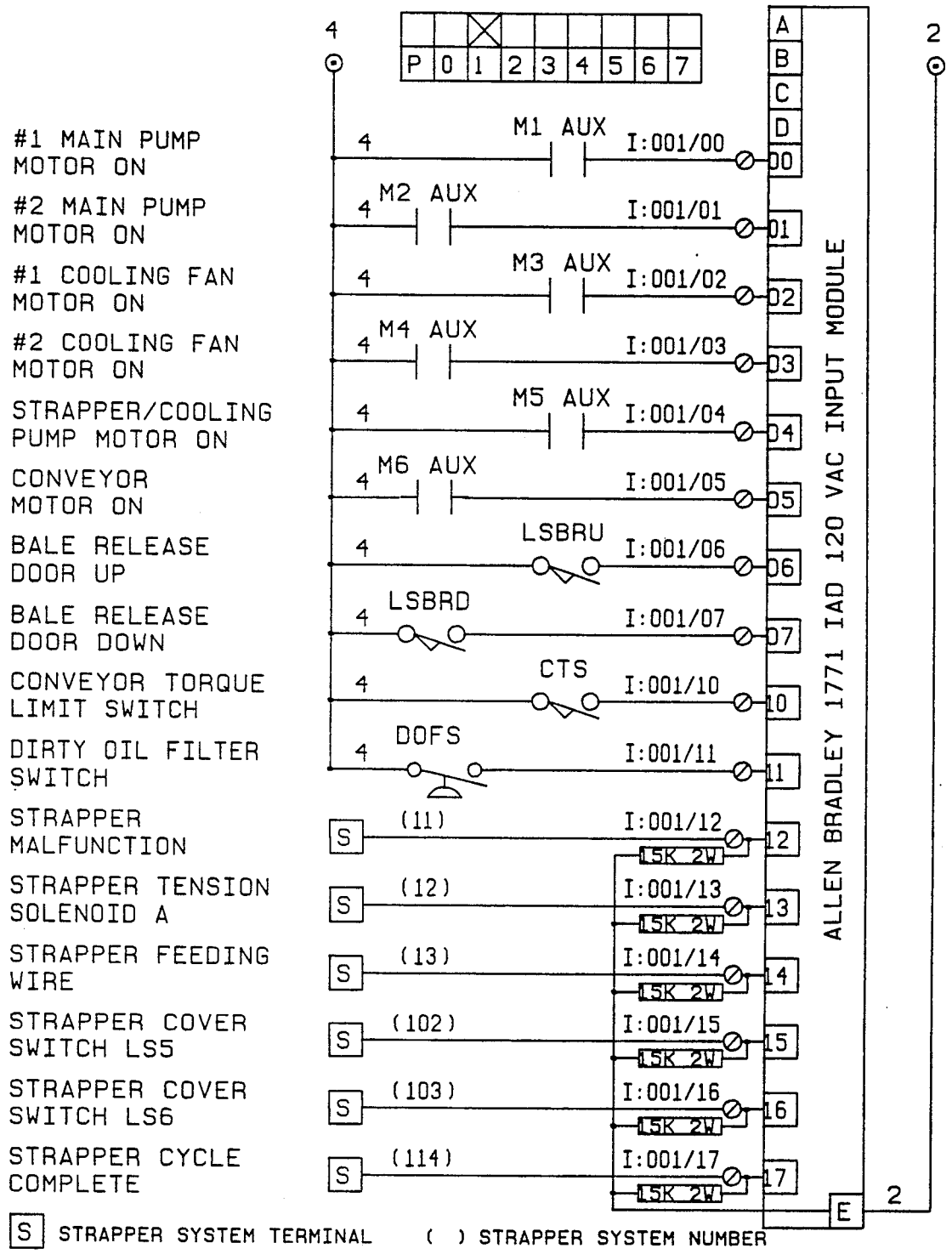

FIGS. 9C and 9D are sheets of miscellaneous connections.

Figure 9E:
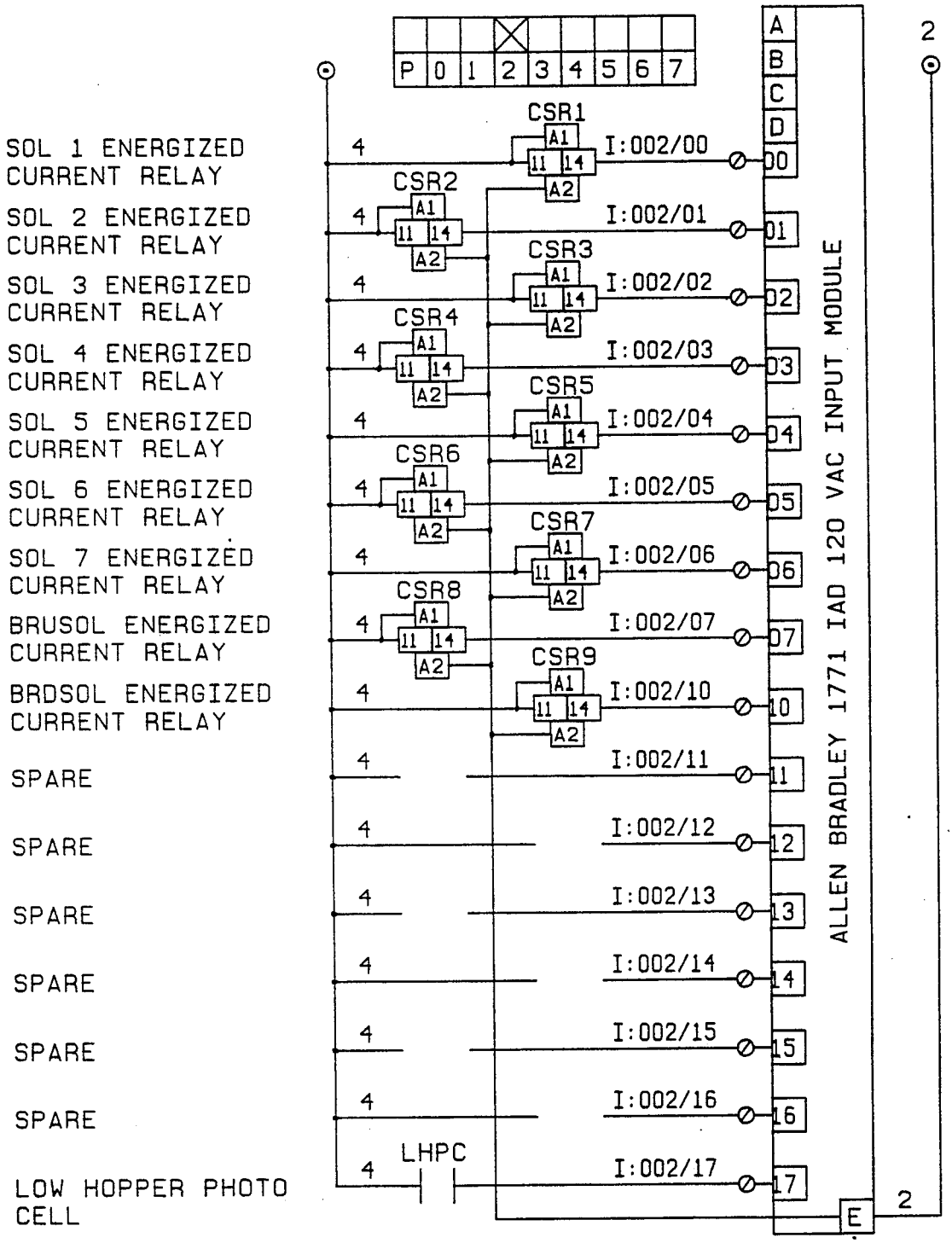
Figure 9F:
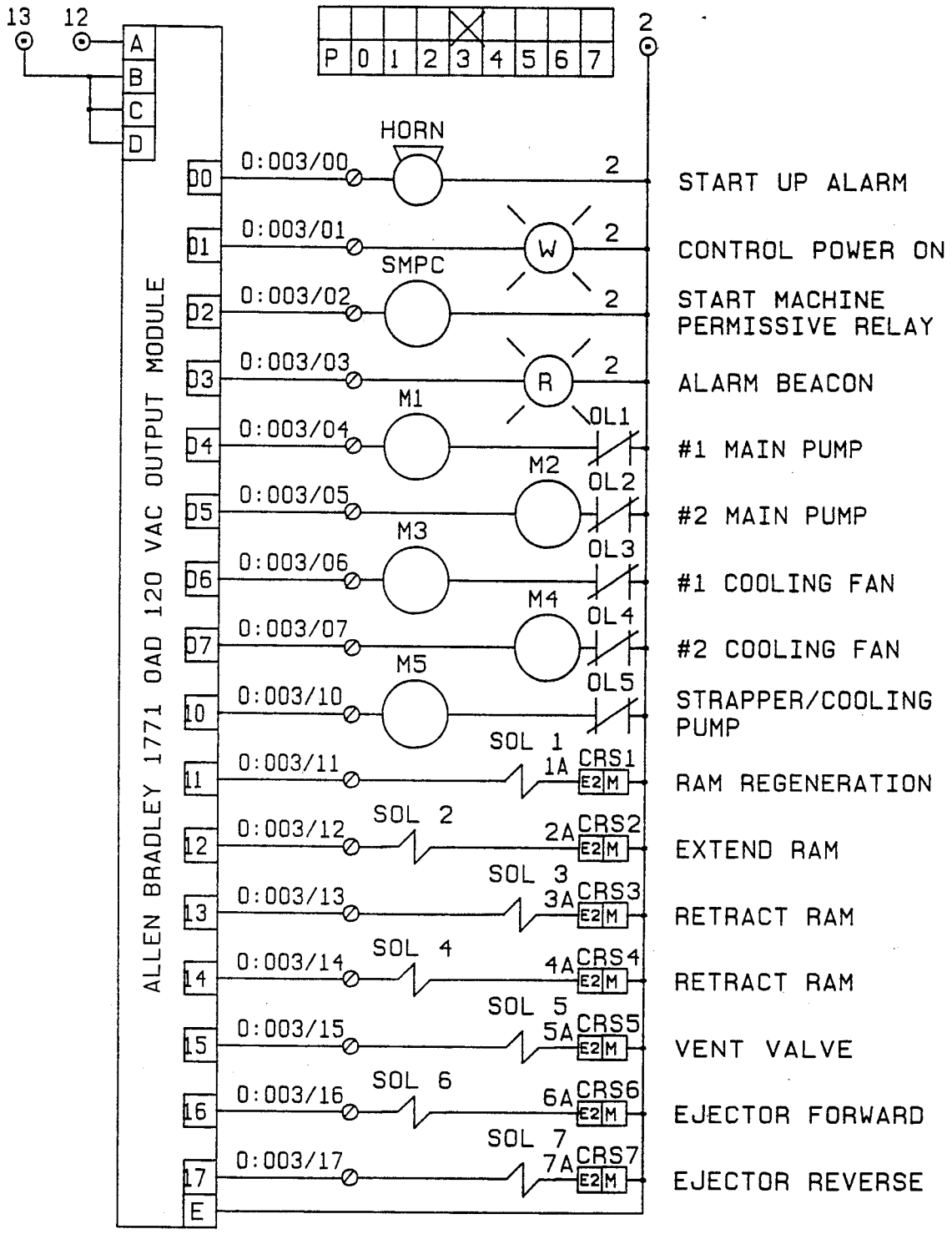

FIG. 9E is current sensing relays for the solenoid coils of FIG. 9F, as well as diagnostic.

Figure 9G:
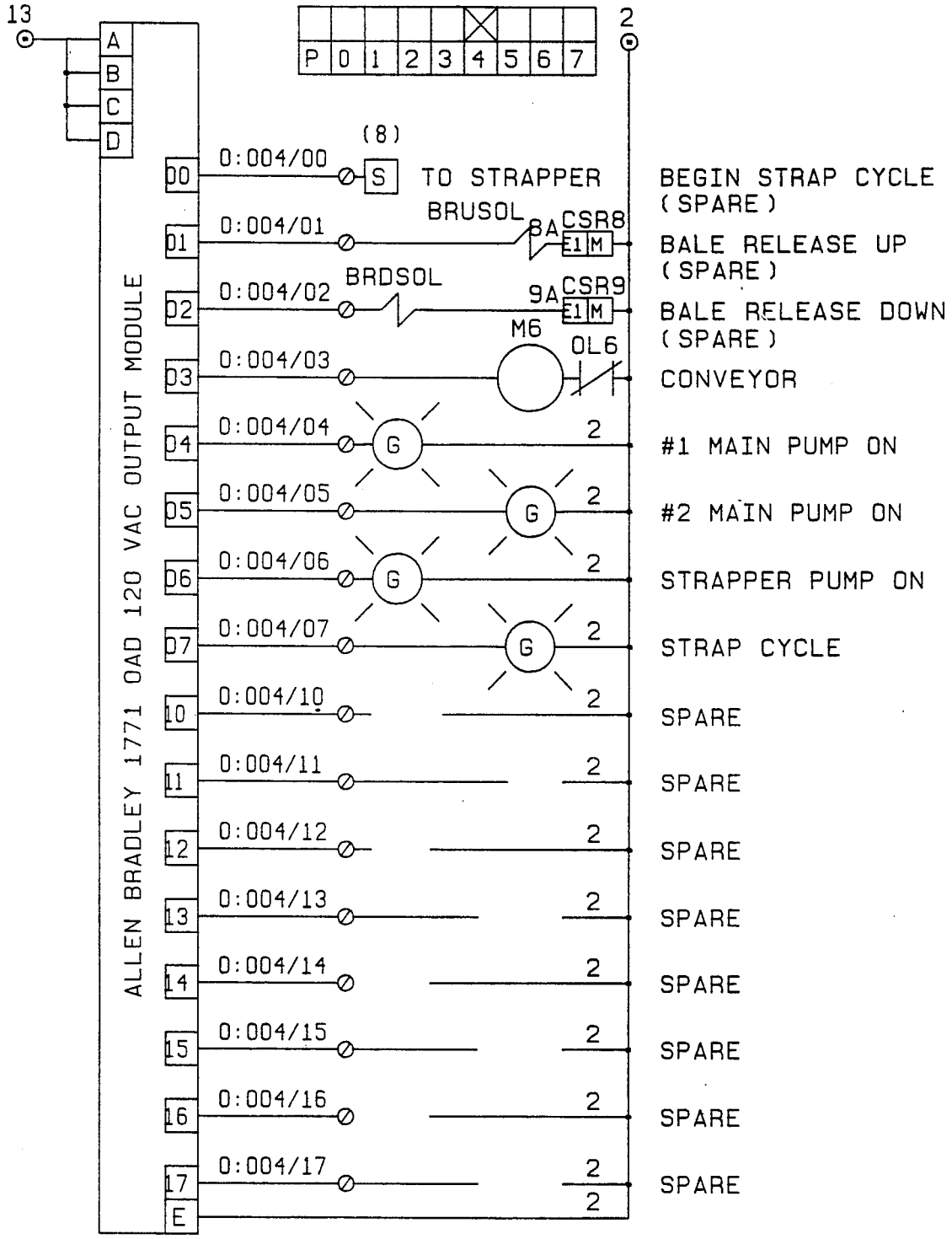

FIGS. 9F and 9G are for operation.

Figure 9H:
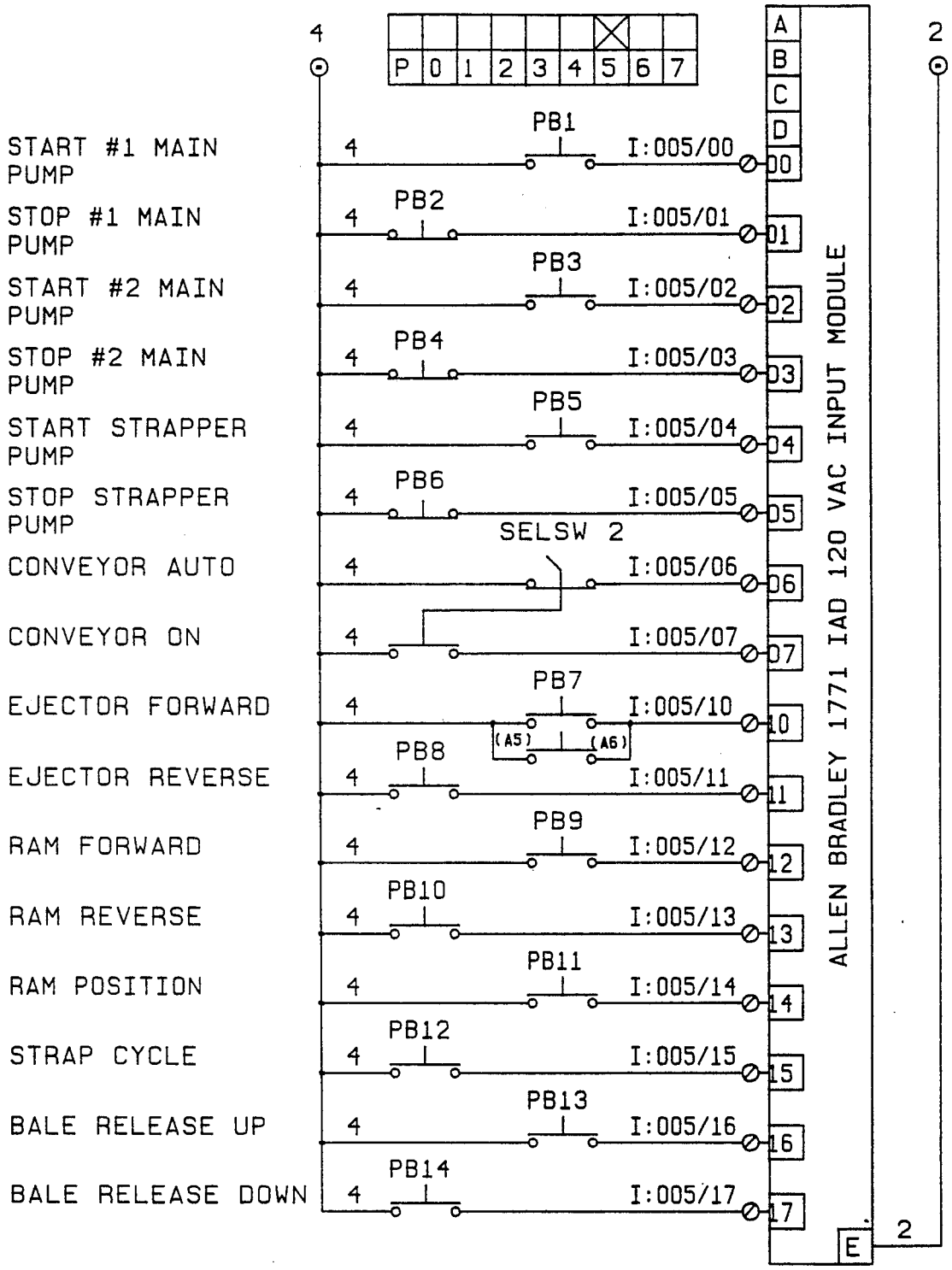

FIG. 9H is for a manual mode operation.

Figure 9I:
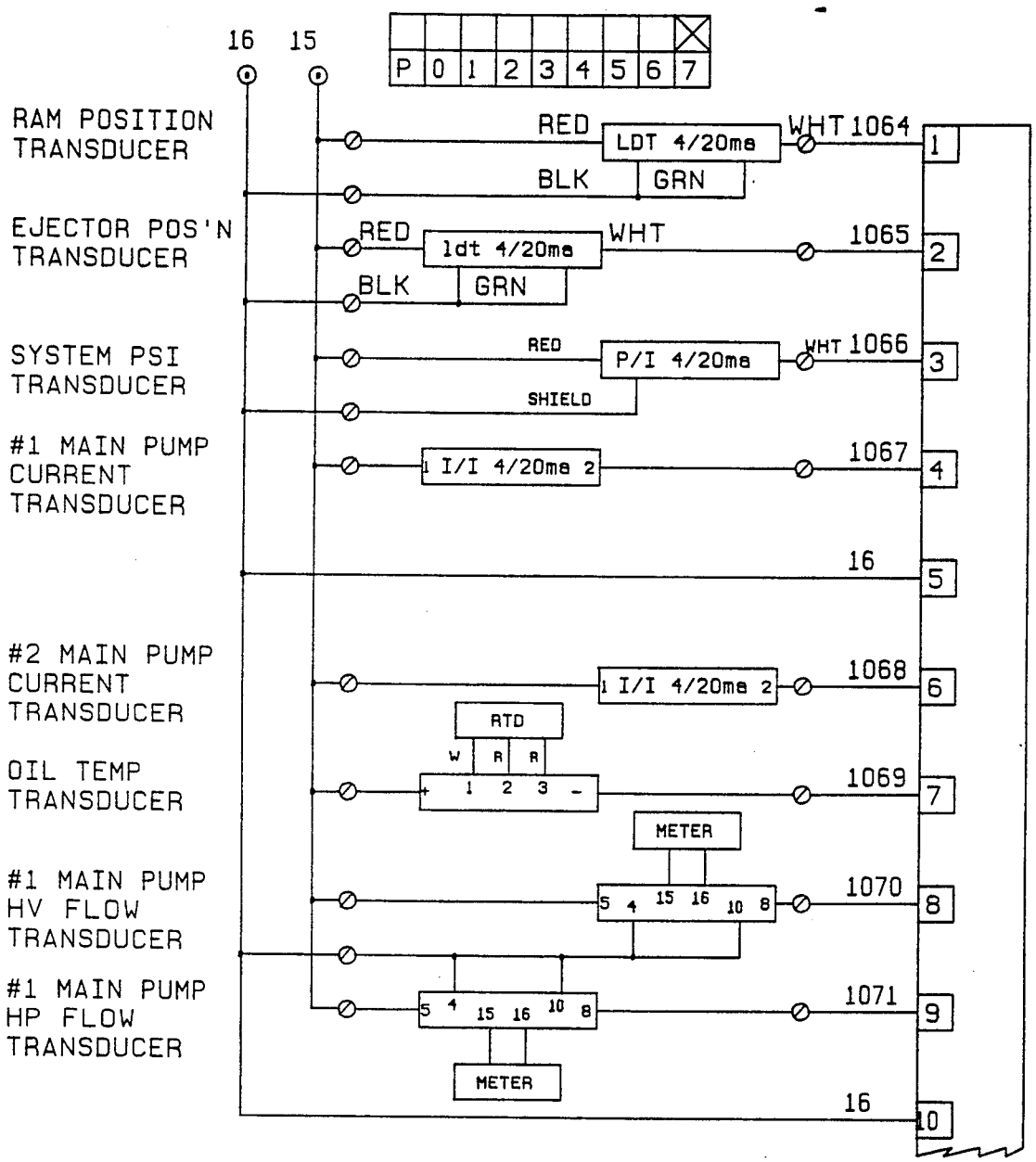
Figure 9J:
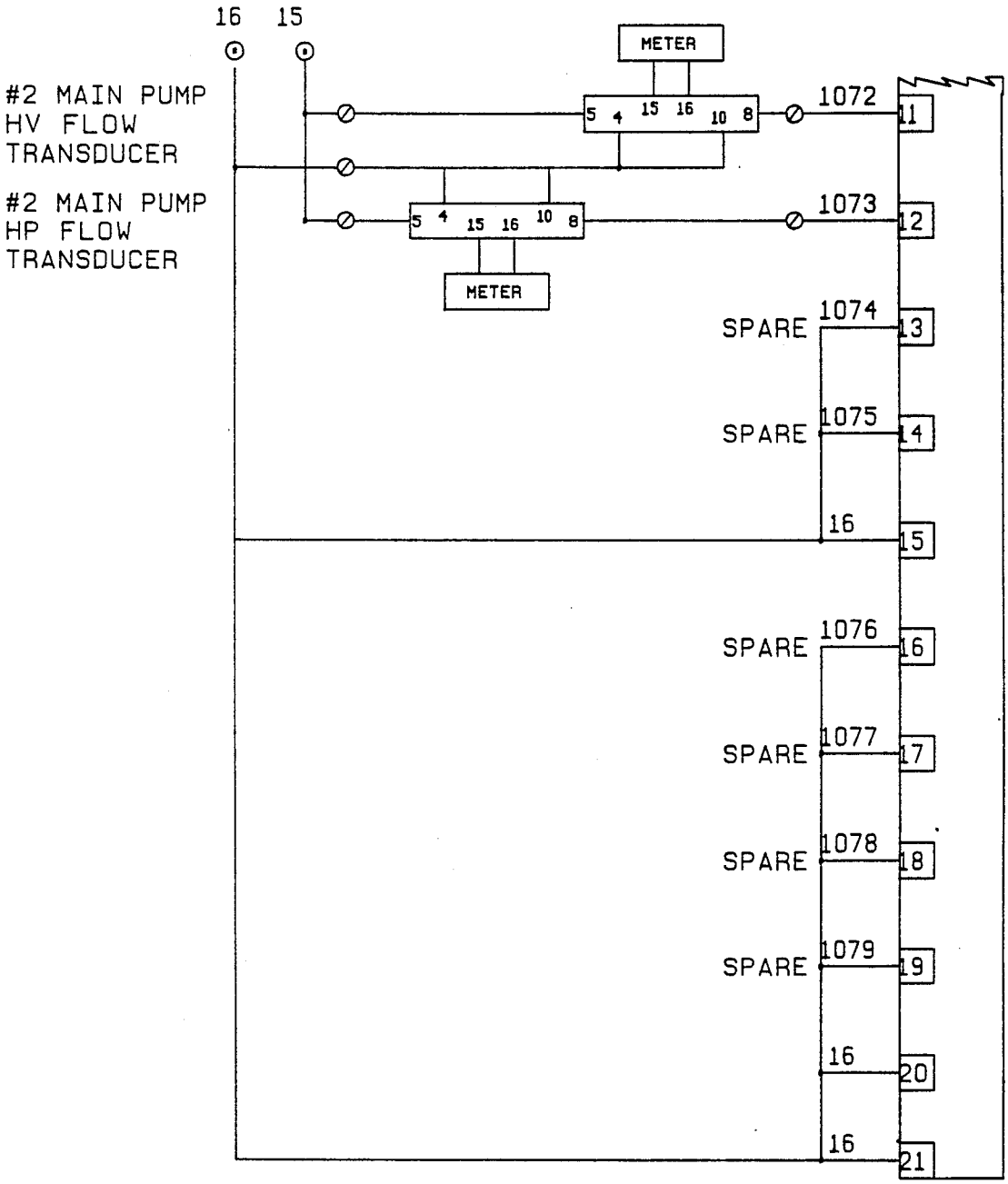
Figure 10B:
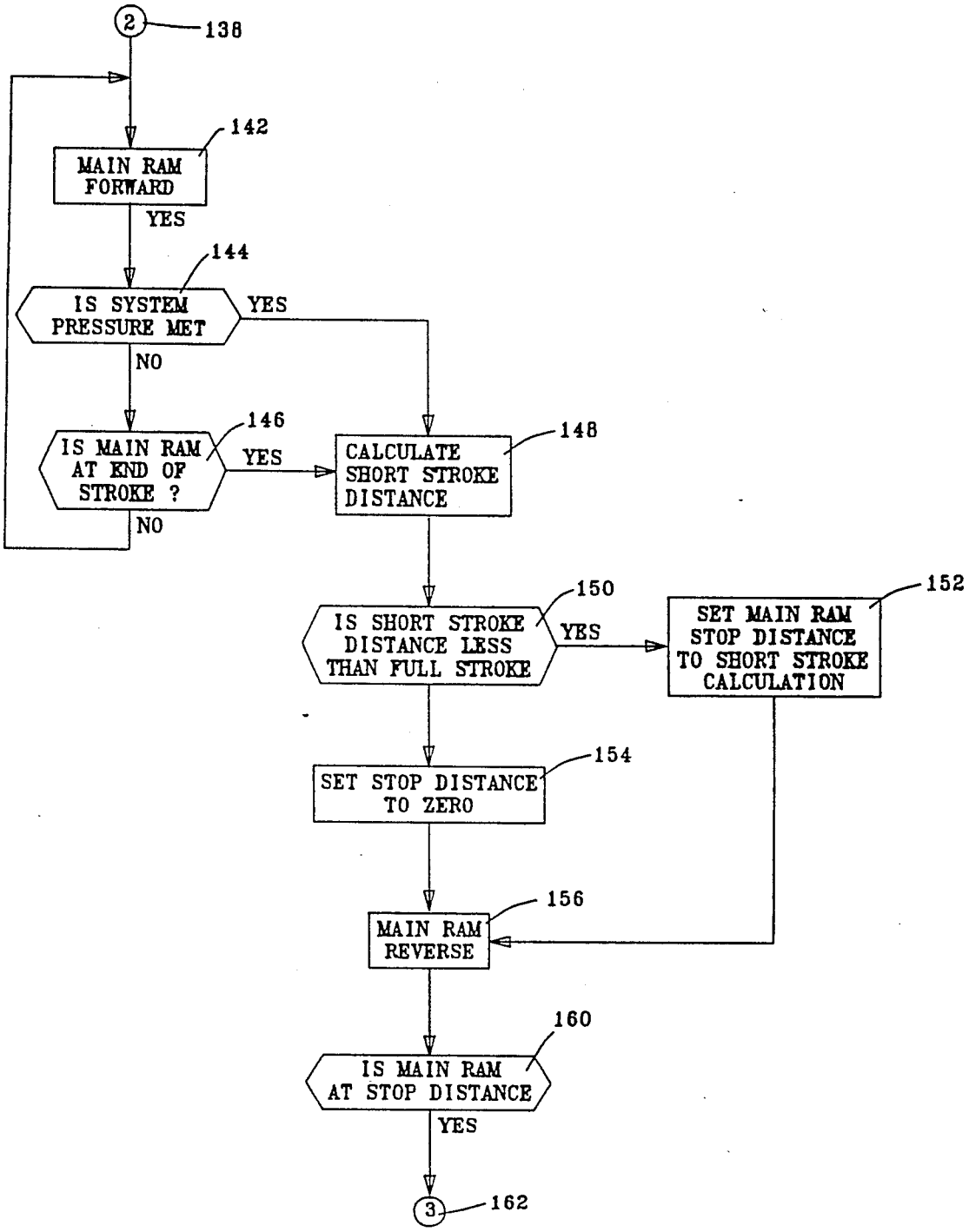
Figure 10C:
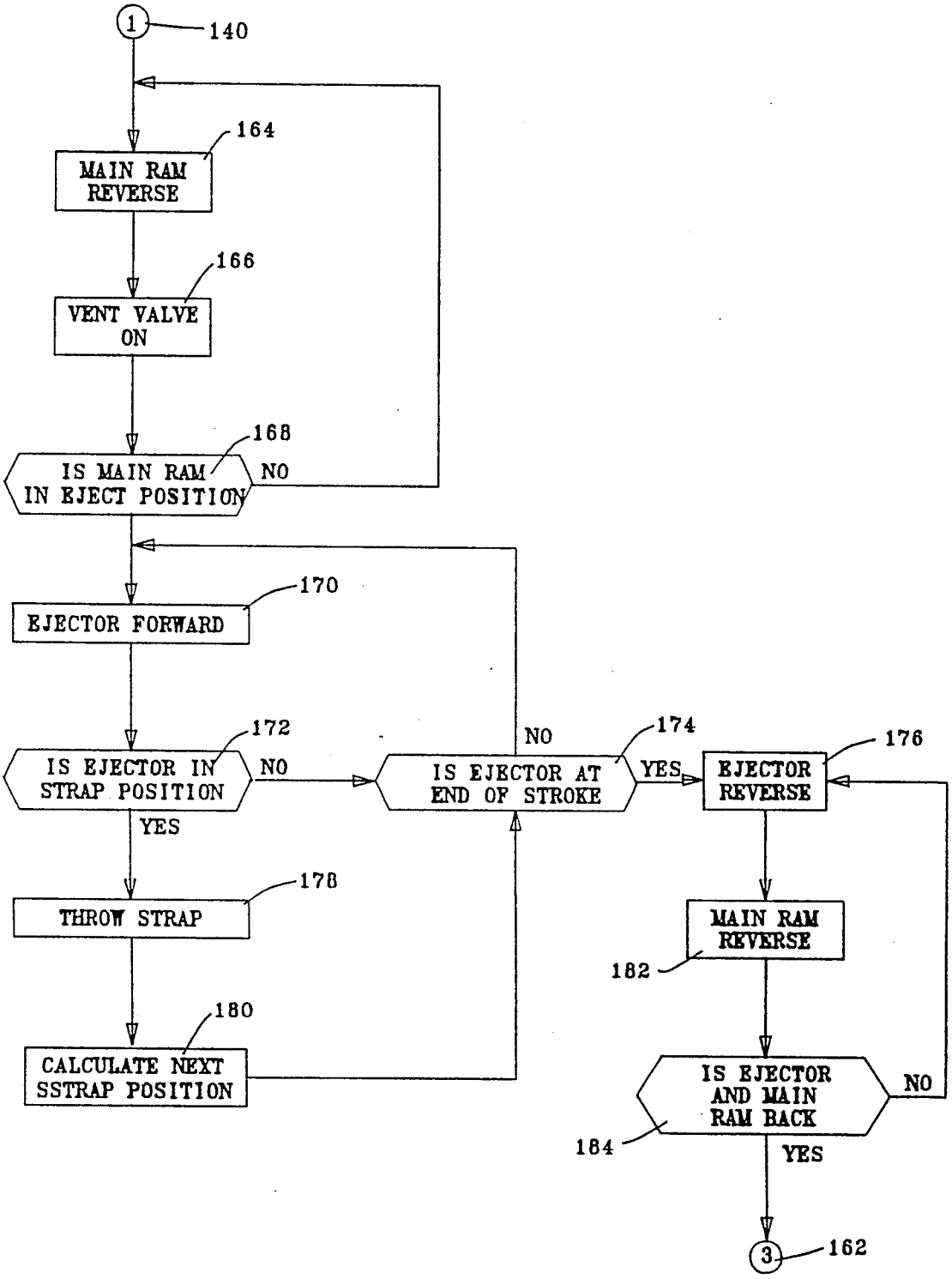

FIG. 9I and 9J are for the analog transducer connections for the baler.

The operation of the baler is controlled by an Allen Bradly 515 Programmable Controller. The programmable controller includes the software of the Appendix on microfiche and generates displays on the video screen of the display of the operator's console, a hi-tech control station.

FIGS. 10A2-10C is a flow chart 100 of the major elements of the software which controls the operation of baler 10. The procedure is entered at element 102 as a result of applying power to the controller. Element 104 determines whether the mechanical hardware is up to speed and functional. This is necessary because the electronic control circuitry of operator console 20 will always be ready before the mechanical components of baler 10. If the operational mode has not yet been attained, element 106 continues to run the diagnostics, and displays the status to the operator (see also the applicable screen display shown in FIGS. 11A-11I2 Element 106 returns control to element 104, which does not permit the program to proceed further until the mechanical components of baler 10 are operational.

When baler 10 becomes fully operational, element 104 forwards control to element 108, which determines whether the operator has entered a change in material on operator console 20. If such a change has been made, element 11 updates the program operational parameters from the data storage to program baler 10 for the newly selected material. These parameters control ram force, ram speed, further operator video displays, etc.

After setting of the material parameters, element 112 determines whether the operator has entered a new strap increment at operator console 20. If yes, element 114 provides the new strap parameters to the program. These parameters are used to control the automated process of strapping the fully compressed bales as discussed in more detail above (see also FIG. 8F).

Element 116 receives control after the strapping parameters have been established. This element determines whether the operator has entered a different compression density into operator console 20. Newly entered density parameters are entered by element 118 as necessary. When element 116 releases control, all program parameters have been entered, and the software program has been supplied with all necessary operator inputs. After this point in time, baler 10 can operate essentially in an automatic fashion until such time as the operator wishes to change one or more parameters of the process.

The conveyor is turned on by the activation of the appropriate contactor (see also FIG. 9A) by element 120. As explained in more detail above, this conveyor transports the material to hopper 22. The conveyor continues in operation until element 122 determines that hopper 22 is full by returning control to element 120 until the full hopper signal is received from the associated sensor.

As soon as hopper 22 is sensed to be full, control transfers to element 124 to disconnect the conveyor motor contactor to prevent overfilling of bale compression chamber 28. Element 126 opens the solenoid to compression cylinder 32 to begin forward movement of compression ram 36 (see also FIGS. 8A-D). As compression ram 36 is advanced, the movement is monitored for jamming at the shear point by element 128. This is an important safety feature. If jamming is detected, element 130 reverses compression ram 36 to 55 inches in a attempt to clear the jam condition. Control is returned to element 126 which again initiates forward movement of compression ram 36.

Assuming that no jam has occurred or has been cleared, compression ram 36 continues forward until element 132 concludes that compression of the bale is completed. This is determined by positional sensing of compression ram 36 (see also FIGS. 9I and 9J). Elements 132 and 134 retain control as compression ram 36 is moved forward.

When the positional sensors indicate that the maximum bale size has been achieved, element 136 determines if the operator selected bale density objective has been met. If yes, control is given to element 140 for strapping and final disposition of the bale. If the density objective has not been met, there is insufficient material in bale compression chamber 28 to complete the bale and control is given to element 138.

Element 138 transfers control to element 142 to continue the forward movement of compression ram 36. The hydraulic system pressure transducer is interrogated at element 144 as a safety feature to ensure that the pressure remains within the safe operating limits. If the maximum safe operating pressure has not yet been reached, element 146 determines whether compression ram 36 has travelled to the end of its stroke. If not, control is returned to element 142 to continue forward movement of compression ram 36. In this manner, the partial bale is compressed as much as possible before the system admits additional material to complete the bale.

If element 144 has determined that the maximum safe operating pressure has been reached or element 146 has determined that compression ram 36 has moved to its maximum forward position, element 148 calculates the partial bale size. Element 150 determines whether this comprises a full stroke. If not, element 152 then initializes short calculation. Otherwise the stop resistance is set to zero, signifying that the maximum forward travel of compression ram 36 has occurred. These values are used by element 156, which moves compression ram 36 in the reverse direction to admit more material. This movement continues until terminated by element 160, which returns control to the element 104 at the beginning of the program.

If the density objective has been met as determined by element 136, the bale is complete and control is transferred to element 140. Element 164 initiates reversal of compression ram 36 to permit strapping and removal of the completely compressed bale. The vent valve is maintained in the open state by element 166. Element 168 monitors the position of compression ram 36 to determine when it reaches the eject position. If not, control is returned to element 164 to continue the reverse direction movement of compression ram 36. When element 168 determines that the ejection position of compression ram 36 has been achieved, element 170 activates forward movement of ejection ram 40 (see also FIG. 8).

The position of ejection ram 40 is monitored by element 172 in conjunction with the appropriate sensor (see also FIG. 9). When ejection ram 40 is determined to be properly positioned for the next programmed strap, element 178 places the strap, and element 180 calculates the position of the next strap to be placed, if any.

Element 174 determines whether ejection ram 40 has travelled a maximum distance whenever the bale is continuing to be positioned for the next strap. Until the maximum distance has been travelled, control returns to element 170 to further advance ejection ram 40. When the maximum distance has been travelled, element 176 begins reversal of ejection ram 40. Element 184 also begins reversal of compression ram 36. Both rams are continued in the reverse direction by element 184 until the initial position has been reached. At that point the completed bale has been strapped and ejected, and control is returned to element 162 to again begin the program with possibly new operator entered parameters.

Figure 11A:
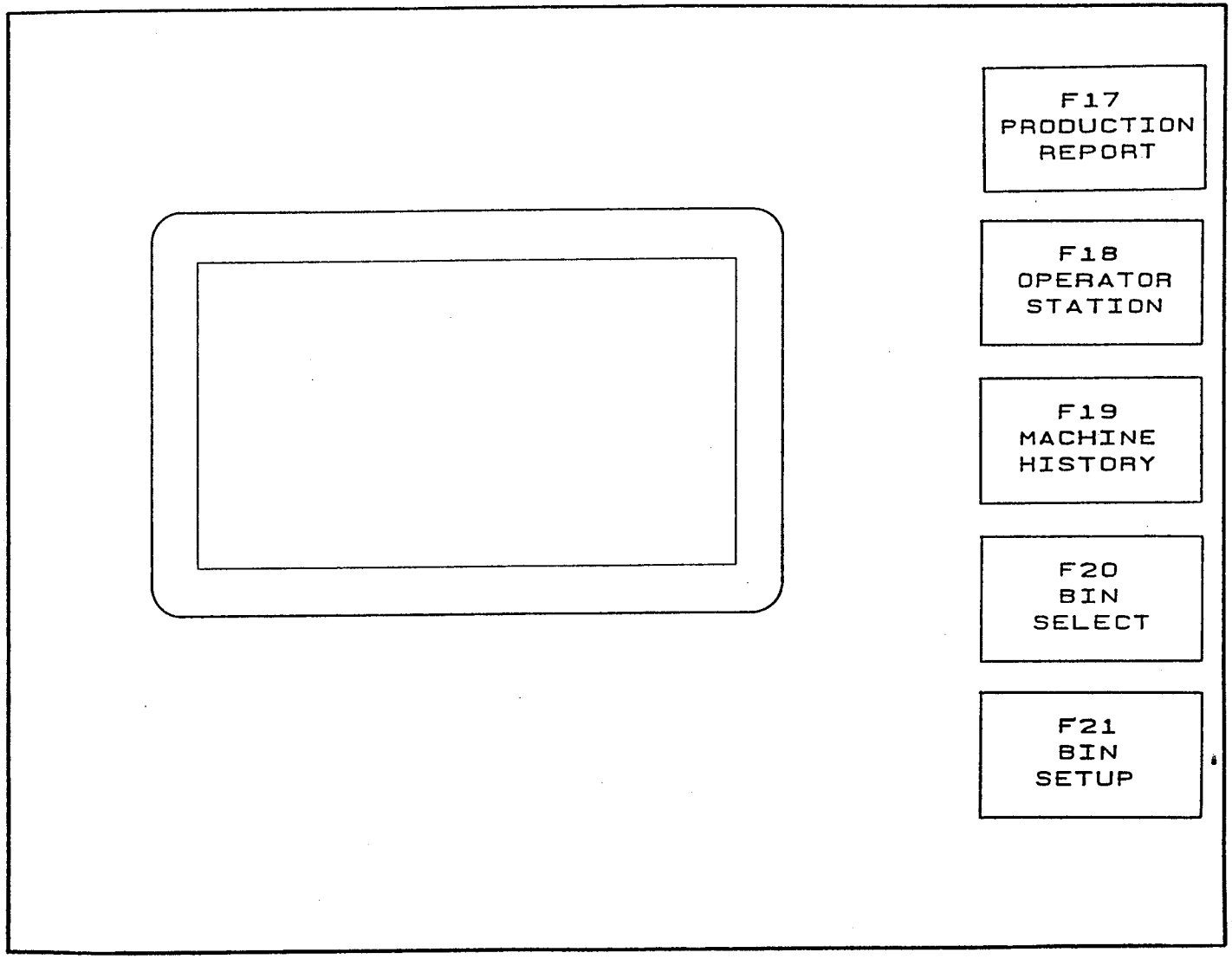
Figure 11B:
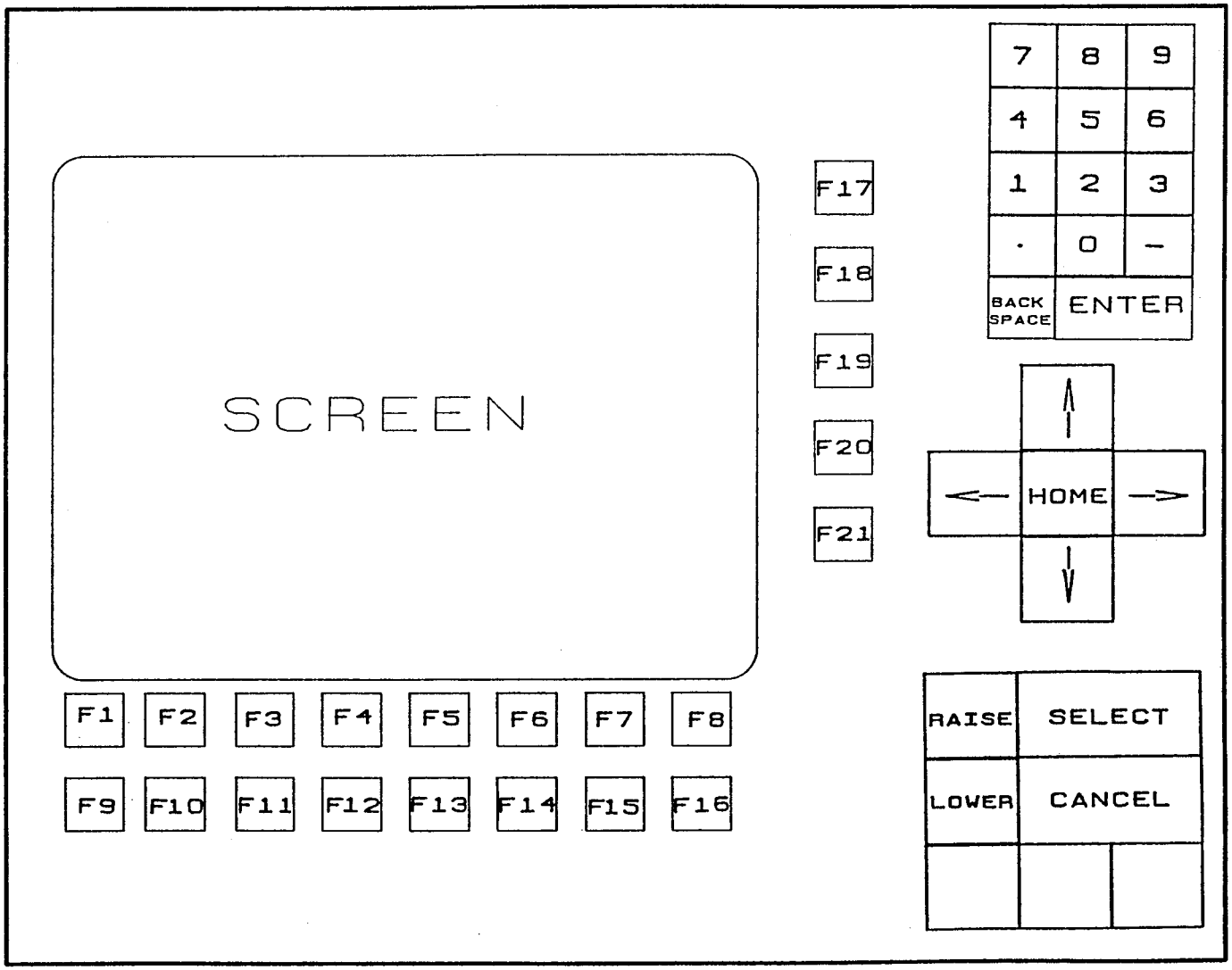
Figure 11C:
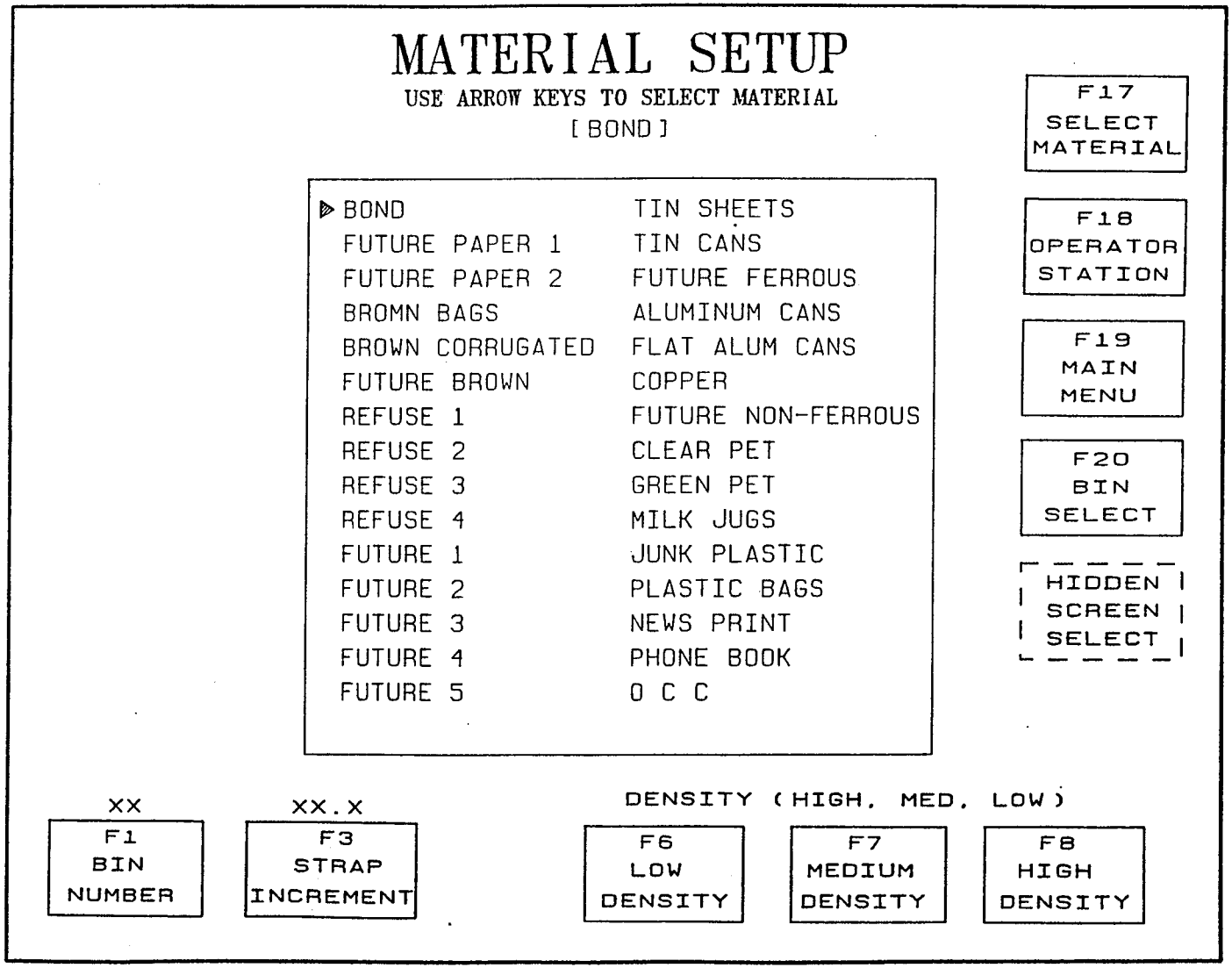
Figure 11E:
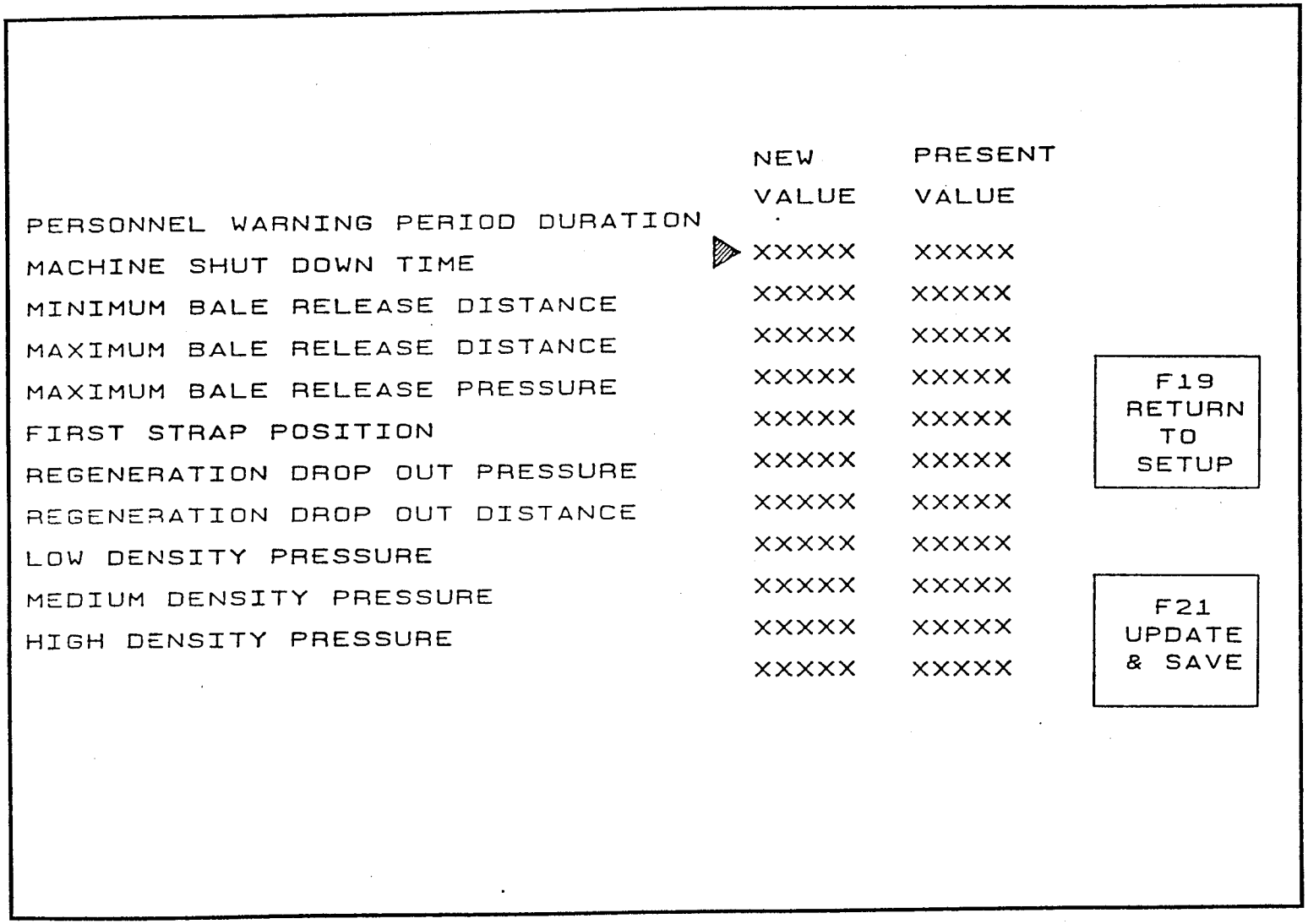
Figure 11F:
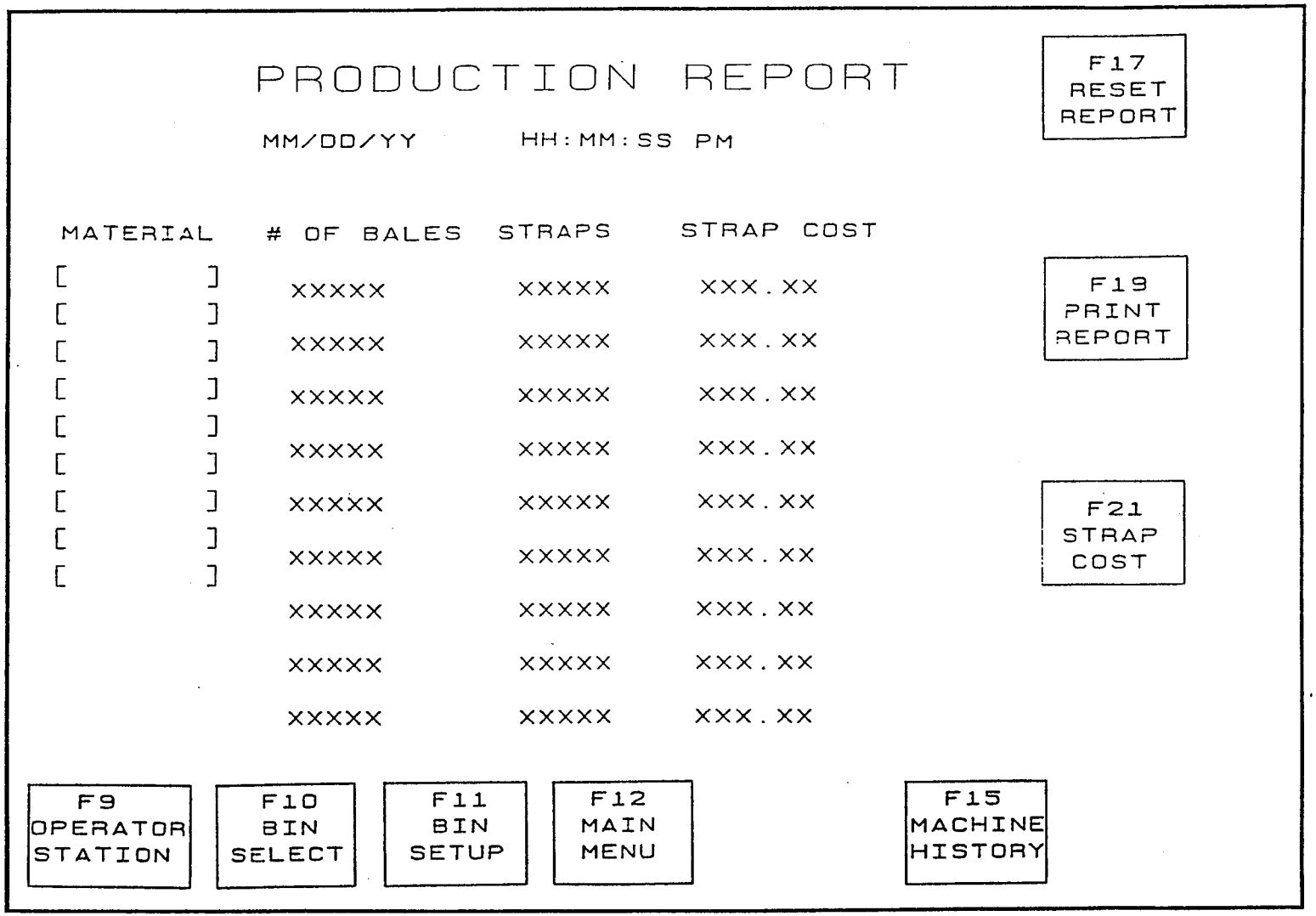
Figure 11G:
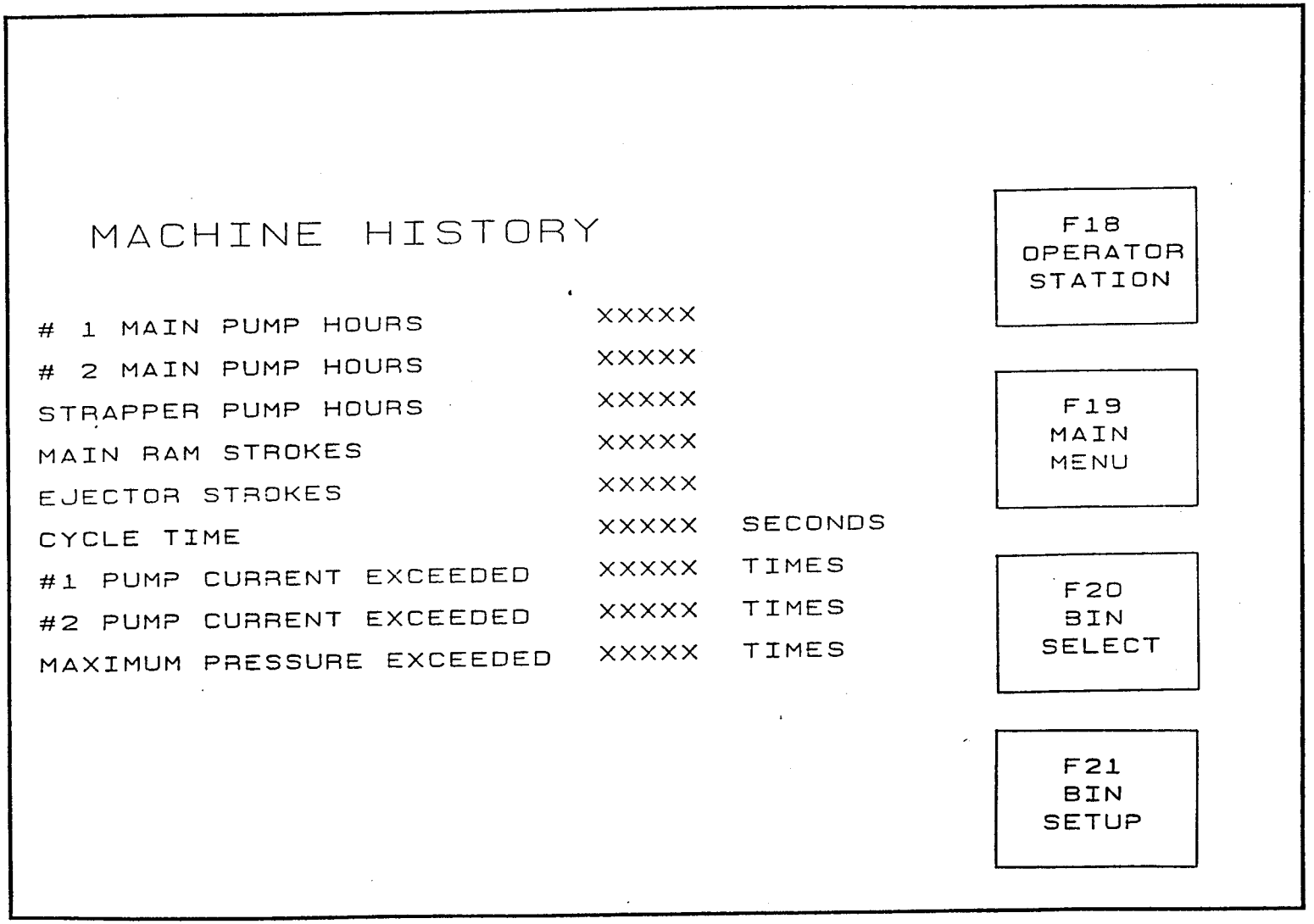
Figure 11H:
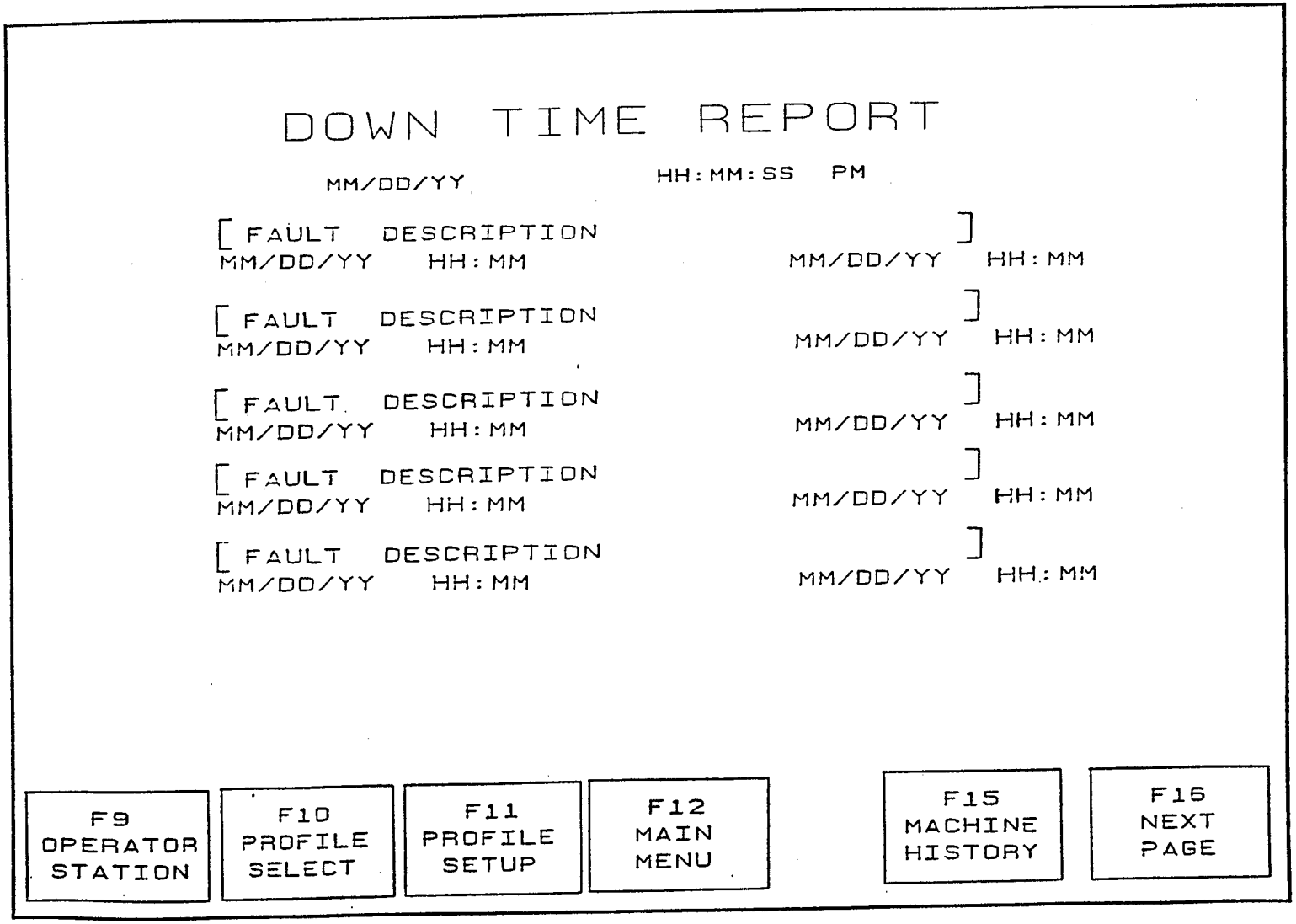

FIGS. 11A–11I2 illustrate video displays on the video screen of the operator's console as generated during operation of the baler 10.

MODE OF OPERATION

The operator's control console mounts at either the front or the rear of the hopper. The operation of the baler is intended to be automated and can be as basic as turning the baler on selecting the material to be baled, selecting the density of the material to be baled, and selecting the distances between the wire strappings. The operation of the baler is intended to be automated by a skilled operator who does not have to be in attendance at the operator's console once operation is commenced, and only needs to be in the immediate area to actuate an emergency shut off switch for whatever reason should such an occasion arise.

The baler includes memory storage to generate reports as to the materials baled at specific density and strappings. The machine also provides for preventative maintenance, such as logging fault reports on the screen and flashing messages to the operator. Finally, the baler troubleshoots itself by shutting down, providing an audible alarm, visual alarm, and flashes messages on the video display for direction to the operator to correct the trouble.

The programmable controller on power up generates the following screen displays of FIGS. 11A–11I2 on the video display according to Table 1.

TABLE 1

1. Operator Station
2. Material Setup
3. Bin Selection
4. Machine Setup
5. Main Menu
6. Machine History
7. Production Report
8. Downtime Report
9. Panel View Layout The programmable controller also generates on the video display an operational view of the compression ram and the ejector ram during operation.

The following sensors connect to the programmable logic controller set forth in Table 2.

TABLE 2

1. Linear positioning devices for the compression ram and the gathering ram.
2. Pressure transducer for the hydraulic system.
3. Flow meters for the four pumps.
4. A thermocouple for the hydraulic oil temperature.
5. Current transducer for the main motor pump indicating either a pump failure or a high pump pressure.
6. Current sensing transducers for the following solenoids:
   a. compression ram forward,
   b. compression ram retract,
   c. compression ram forward regeneration,
   d. ejector ram forward,
   e. ejector ram retract,
   f. bale release up,
   g. bale release down, and
   h. hydraulic tank vent solenoid.

The analog sensors of FIGS. 9I and 9J operate on 4–20 mA. If there is a sensor failure, the signal from the sensor drops below 4 miliamps, then one can assume that the sensor is defective. If all of the sensors drop below 4 miliamps, then there is a problem with the 24 volt DC power supply or fuse. The odds of all of the sensors failing at the same time, is remote. At a zero state, the sensors are at 4 miliamps. The analog sensors are for machine control, as well as diagnostics. The diagnostic aspect, as an example, is using the system pressure transducer, the flow meter, and the position transducer to detect any problems with the hydraulic circuitry.

If there is flow, but one doesn't have maximum pressure with the position transducer, one determines that the ram has stopped, then one knows that there is a leak some where. If the leak is not in the plumbing, which an operator could tell, the leak is going to be 1) in a valve, or 2) in the piston itself; probably, in the piston seal. This would tell the operator that there is a piston seal leak. Then the help screen would display a message to check the machine out for obvious leaks. If there is a reduced flow, which one would determine with a flow meter, such as reduced flow at close to system pressure, where one is checking system pressure to 2400 psi. One checks the flow between 2200 and 2300 psi which should be before the relief valves starts relieving; and then, if the flow is something less than what it started out, then one can tell that the pump is starting to go bad. If the system is not putting out the pressure, it could also be a defective relief valve.

Limit switches on the ejector and on the main ram are in the zero position all the way back. If the position transducer says that the ram is back and the ram is not on the limit switch, then one knows that there is a defective transducer. If one is on the limit switch and the transducer says that the ram is out some where, then that is also an indication that there is a defective transducer.

The temperature transducer is just controlling the cooling system, which is automatic as long as the strapper pump is on. This also allows the coolant function.

The motor current transducers on the #1 and #2 main pump monitors the motors for various problems. One can tell, for example, when, actually before one stalls, that one is fixing to stall.

The actual flow meters are in the hydraulic lines on the output of the hydraulic pumps. Each motor drives 2 pumps, a high pressure and a high volume pump, and there is one flow meter for each pump. The flow meter is after the relief valve.

The third motor is the strapper and cooling pump with a high volume and a high pressure pump on it. The high pressure pump goes to the strapper, and the high volume pump is for cooling. The high volume pump circulates the hydraulic oil through the radiators.

There are also four pumps for the ram and the ejector.

The position transducer and flow meters tell that there is a stall. When one is pushing material and there is a stall, for example, at the shear point, one backs up, which is indicated on the flow chart, and that is how one knows that there is a stall. When the position transducer senses this condition and the flow meter has gone to zero, meaning that there is relieving, then it is an indication that one has stalled. If one is at the shear point, for example, one backs up and tries again. The system pressure transducer is constantly monitoring the pressure. The main pump current transducers are monitoring the motor current, whole temperature is just controlling the fans basically.

Various modifications can be made to the present invention without departing from the apparent scope hereof. The teachings of the present invention are applicable to balers in general, especially with respect to the video displays generated on the video screen.

We claim:

1. A baler comprising:

a. a baler means including a hopper for receiving material, a compression chamber adjacent said hopper for gathering material from the hopper to be compressed, and a compression ram for compressing material in the compression chamber;

b. a bale chamber for forming a bale of material compressed in the compression chamber and an ejector ram for ejecting a compressed bale from the bale chamber;

c. hydraulic means connected to said compression ram and to said ejector ram;

d. means for sensing hydraulic pressure;

e. means for sensing distance of travel of said compression ram and of said ejector ram;

f. control means connected to said hydraulic means and said distance sensing means;

g. means for storing a plurality of operator-selectable algorithms in said control means for baling different materials at different densities; and, h. means for displaying multiple materials for operator selection and multiple densities for operator selection; and, i. means for automatically selecting one of the algorithms based on operator selections.

2. A baler of claim 1 including means for automatically strapping bales based on stored strapping parameters and algorithm means in said control means for selecting different strapping parameters.

3. A baler of claim 2 including means for generating displays representative of strapping parameters.

4. Process for generating video displays during baler operations comprising the steps of:

a. sensing hydraulic pressure;

b. sensing distance of travel of a compression ram and an ejector ram;

c. generating a cross-sectional view of a baler display;

d. generating a compression ram and ejector ram display in said cross-sectional view; and, e. generating movement of said compression ram display and said ejector ram display with respect to said distance of travel of said compression ram and said ejector ram.

5. A controller for a waste material baler comprising:

a. a hydraulic ram;

b. means for sensing hydraulic pressure of the ram;

c. means for sensing distance of travel of the ram;

d. means for generating a cross-sectional view of the baler;

e. means for generating, on the cross-sectional view, a representation of ram position; and, f. means for displaying on the cross-sectional view movement of the ram.

6. The controller of claim 5 further comprising:

a. an ejector ram;

b. means for displaying, on the cross-sectional view, a representation of the ejector ram position; and, c. means for displaying, on the cross-sectional view, movement of the ejector ram.

7. In a waste baler of the type having a horizontal hydraulic baler ram for compressing waste and an ejector ram for ejecting baled waste, a controller comprising:

a. a baler ram position sensor for determining horizontal position of a baler ram;

b. a pressure sensor for determining hydraulic pressure on the baler ram;

c. a display screen; and, d. means responsive to the position sensor and pressure sensor for displaying a cross sectional view of the baler on the screen, including a view of the baler ram.

8. The controller of claim 7 further comprising means for displaying movement of the baler ram on the screen.

9. The controller of claim 7 further comprising means for displaying the ejector ram on the screen, including means for representing movement of the ejector ram.

* * * * *